US009780534B2

(12) United States Patent
Chirila

(10) Patent No.: US 9,780,534 B2
(45) Date of Patent: Oct. 3, 2017

(54) MULTI-ELECTRODE SPARK PLUG

(71) Applicant: Laurian Petru Chirila, Irvine, CA (US)

(72) Inventor: Laurian Petru Chirila, Irvine, CA (US)

( * ) Notice: Subject to any disclaimer, the term of this patent is extended or adjusted under 35 U.S.C. 154(b) by 0 days.

(21) Appl. No.: 15/261,475

(22) Filed: Sep. 9, 2016

(65) Prior Publication Data

US 2017/0077680 A1 Mar. 16, 2017

Related U.S. Application Data

(60) Provisional application No. 62/216,925, filed on Sep. 10, 2015.

(51) Int. Cl.
*H01T 13/20* (2006.01)
*F02P 15/00* (2006.01)
*H01T 13/46* (2006.01)

(52) U.S. Cl.
CPC ..... *H01T 13/20* (2013.01); *F02P 15/00* (2013.01); *H01T 13/467* (2013.01)

(58) Field of Classification Search
CPC ..... H01T 13/20; F02P 15/00
See application file for complete search history.

(56) References Cited

U.S. PATENT DOCUMENTS 2,605,754 A 8/1952 Smits
3,173,106 A 3/1965 McCulloch
4,004,562 A 1/1977 Rado et al.
4,585,421 A 4/1986 Payne
5,821,675 A * 10/1998 Suzuki ..... H01T 13/462 313/123
6,064,143 A * 5/2000 Kagawa ..... H01T 13/52 123/169 EL
6,104,130 A 8/2000 Below
6,583,539 B1 6/2003 Zamora
6,586,865 B1 * 7/2003 Tamai ..... H01T 13/26 313/125
2002/0109126 A1 8/2002 Kise et al.
2005/0127809 A1 * 6/2005 Lindsay ..... H01T 13/39 313/141
2005/0264153 A1 12/2005 Hanashi
2010/0026446 A1 2/2010 Takeda
2014/0261296 A1 9/2014 Sotiropoulou et al.

* cited by examiner

*Primary Examiner* — Donald Raleigh
*Assistant Examiner* — Kevin Quarterman
(74) *Attorney, Agent, or Firm* — Myers Andras LLP; Joseph C. Andras

(57) ABSTRACT

A multi-electrode spark plug having a large spark target volume is disclosed. The spark plugs have a plurality of ground electrode rods which extend from the base of the spark plug and are twisted around center electrode to provide a plurality of substantially equidistant spark points relative to the center electrode. The spark points are formed in parallel and around the elongated axis of the spark plug. This configuration enables the spark to be created where the localized concentration of fuel to air is richer, such as that which may exist when the engine is operating with lower revolutions per minute. Test results indicate that automobiles equipped with the multi-electrode spark plugs exhibit improved fuel economy, and substantially reduced emissions and air pollution.

20 Claims, 27 Drawing Sheets

Traditional J-Type Spark Plug

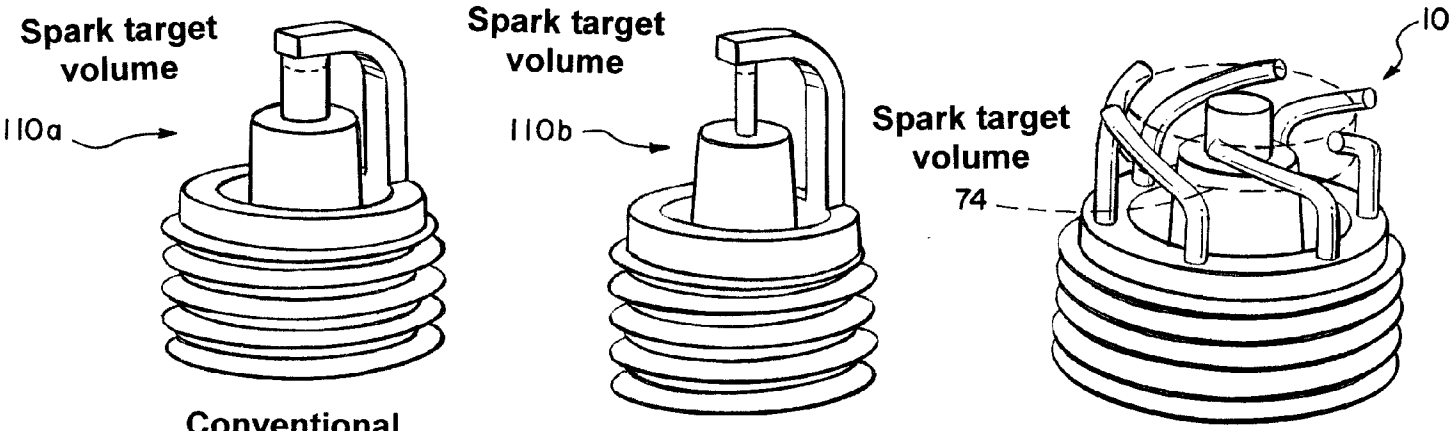
Intelligent Spark Plug
FIG. 6C
Conventional Iridium
FIG. 6B
Conventional Platinum
FIG. 6A
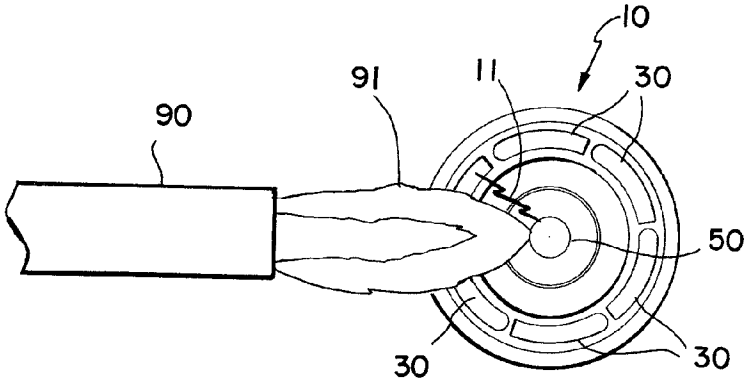
FIG. 7

| Spark Plug | HC (PPM) | CO (%) | NO (PPM) |
|---|---|---|---|
| Market Leader 15 MPH | 50 | 0.09 | 387 |
| Intelligent Spark Plug 15MPH | 6 | 0.00 | 52 |
| Improvement delta | 44 | 0.09 | 335 |
| Intelligent Spark Plug Superior by: | >8.3 times | >9 times | >7.4 times |

FIG. 26

MULTI-ELECTRODE SPARK PLUG

RELATED APPLICATION INFORMATION

The present application claims priority under 35 U.S.C. Section 119(e) to U.S. Provisional Patent Application Ser. No. 62/216,925 filed Sep. 10, 2015 entitled "MULTI-ELECTRODE SPARK PLUG" the disclosure of which is incorporated herein by reference in its entirety.

BACKGROUND OF THE INVENTION

1. Field of the Invention

The present invention relates in general to spark plugs for internal combustion engines and, more particularly, to spark plugs having multiple ground electrodes forming large, three-dimensional spark volumes.

2. Description of the Related Art

As is well known, an internal combustion engine is a type of engine where the expansion of gases produced by combustion applies force to some component of the engine. In a reciprocating engine, the piston moves up and down within a cylinder and transfers force from expanding gas to turn a crankshaft via a connecting rod. The piston is usually made gas-tight with the cylinder using piston rings. The combustion chamber consists of the space within the cylinder above the piston where the burning of the fuel/air mixture occurs.

There are various kinds of internal combustion engines, but the most common variants are two-stroke and four-stroke, gasoline powered engines. Such engines have at least one cylinder, and often have more (e.g., 4, 6, 8, 12 cylinders, etc.). Regardless of the cycle type and number of cylinders, an air-fuel mixture is compressed by the piston when it moves in one direction (i.e., the compression stroke) and then ignited by a spark plug to drive the piston in the opposite direction (i.e., the combustion stroke).

In a two-stroke engine, the piston completes a full power cycle in only two strokes because the end of the combustion stroke and the beginning of the compression stroke happen at the same time, and because the intake and exhaust functions also happen at the same time. This is possible because the reciprocating piston blocks and unblocks intake and exhaust ports that are located in the side wall of the cylinder.

In a four-stroke engine by contrast, commonly used in automotive applications, the piston completes four separate strokes per power cycle, including intake, compression, power, and exhaust strokes. A four-stroke engine typically uses intake and exhaust valves that are located in the cylinder head that seal the piston within the cylinder. The intake and exhaust valves open and close corresponding ports at the appropriate time and for an appropriate duration during the intake and exhaust strokes of each four-stroke power cycle (i.e., intake, compression, power, and exhaust strokes).

The combustion is accomplished by combining a fuel (e.g., gasoline) with an oxidizer (e.g., air) to create a fuel-air mixture and then igniting the fuel-air mixture with an ignition system. In a traditional vehicle, the ignition system consists of several spark plugs (one for each cylinder), an ignition coil or other source of high voltage, a distributor that directs the high voltage from the ignition coil to an output associated with each spark plug, and spark plug wires that carry the high voltage from the outputs of the distributor to each corresponding spark plug and thereby induces a spark that ignites the surrounding fuel-air mixture.

A spark plug ignites the fuel/air mixture in a gasoline engine. According to Wikipedia, a spark plug is "[a] device for delivering electric current from an ignition system to the combustion chamber of a spark-ignition engine to ignite the compressed fuel/air mixture by an electric spark, while containing combustion pressure within the engine."

FIG. 1 shows a typical J-type or single-electrode spark plug 110. It comprises a metal spark plug shell 120 having with threads 122 that engage a threaded hole in the cylinder head and a single ground electrode 130 that protrudes from a bottom 121 of the spark plug shell 120 and extends downward and then inward to provide the familiar J-shape, an insulated body 140 (e.g., porcelain, high purity alumina, etc.), a center electrode 150 that is surrounded by the insulated body 140 and extends from a terminal 160 that mates with a spark plug wire (not shown) to extend out of the bottom of the insulated body 140 where it terminates very near to the ground electrode 130. The space between the center electrode 150 and the ground electrode 130 defines the "spark gap" 135. If desired, the gap 135 can be adjusted by bending the ground electrode 130 with a suitable tool.

In operation, when high voltage is supplied to the center electrode 150, spaced very near the ground electrode 130, the fuel/air mixture in the spark gap 135 becomes ionized, forming a low resistance electrical path, and the spark plug "fires" by having a spark jump the gap between the two electrodes. The spark ignites the fuel/air mixture located within the combustion chamber, which rapidly burns, expands, and moves the piston within the cylinder.

Engineers have used various techniques to try to create a more homogenous fuel/air mixture that leads to a more efficient engine. For example, in an effort to create and control turbulence, some may have modified the configuration of the combustion chamber by changing the shape of the piston head or internal shape of the cylinder head, or by increasing the number of valves and corresponding ports in an attempt to inject the fuel/air mixture in a spiral pattern, for example. Nonetheless, the fuel/air mixture remains non-homogenous especially at low engine revolutions per minute ("RPMs"), consistent with "stop and go" driving typical of city driving, resulting in imperfect/slow combustion, fouled plugs, increased emissions/pollution, and lower fuel economy. Cars driven on highways at more constant speeds (rather than the "stop and go" type of city driving) keep the engines running above 2000 RPMs and makes the fuel/air mixture more homogenous and hence the cars will have less emissions/pollution and will be more efficient.

The market has seen some multi-electrode spark plugs that offer varying degrees of improvement over a traditional J-type spark plug, but they still suffer from certain deficiencies. For example, FIG. 2 shows an exemplary spark-plug 210 that has two ground electrodes 230 on opposite sides of a center electrode 250. In similar fashion, FIG. 3 shows another exemplary spark plug 310 that has four ground electrodes 330 that surround a center electrode 350.

Some believe that the spark plugs 210 and 310 shown in FIG. 2 and FIG. 3 are not helping more on the "stop and go" type of city driving but are helping for longer mileage between spark plug changes due to the fact that when one ground electrode becomes fouled, another ground electrode will inherently become more attractive to the spark by virtue of it not yet being fouled. However, each individual ground electrode circumferentially offer a limited and very narrow target volume/area for a spark jump, and each ground electrode extends from the spark plug like a conventional J-type electrode such that the extension tends to hinder the spark's access to the adjacent fuel/air mixture.

In addition, the J-type of the electrodes 330 from FIG. 3 and the way how the electrodes 330 are arranged will slow down the propagation of the explosion inside the combustion chamber leading back to slow and inefficient burn of the air fuel mixture, increasing the emissions and lowering the mileage. Further increasing the numbers of J-type electrodes to 5, 6, or more electrodes will shield even more the sparking area from the rest of the combustion chamber slowing down the propagation of the explosion and canceling the benefit of having 2, 3, 4, or more sparking paths.

According, there exists a need for improving the performance of spark plugs.

SUMMARY OF THE INVENTION

In the first aspect, a spark plug is disclosed. The spark plug comprises an insulating body having an open bore, a tubular conductive shell surrounding at least a portion of the insulating body, and a cylindrical center electrode positioned within the bore of the insulating body, the center electrode having a central longitudinal axis, the center electrode protruding from the insulating body forming a terminal end portion adapted to act as a spark generating portion. The spark plug further comprises a plurality of ground electrodes surrounding the center electrode, each ground electrode having a base end coupled to the conductive shell and an upper portion forming a generally curved path having a generally constant radial spark gap distance from the center electrode and extending partially along the longitudinal axis.

In a first preferred embodiment, the curved path comprises a portion of a helix formed about the longitudinal axis of the center electrode. The radial spark gap is preferably in the range of approximately 1.7 millimeters to approximately 4.75 millimeters. The spark generating portion of the center electrode and the upper portions of the ground electrodes preferably form a three-dimensional spark target volume. The spark target volume is preferably up to approximately 100 cubic millimeters. The spark target volume preferably comprises a generally open volume adopted for allowing free propagation of fuel burn. One of the plurality of ground electrodes preferably comprises a bi-metal structure configured to move radially away from the center electrode with increased temperature. One of the plurality of ground electrodes preferably comprises a conductor having a Positive Temperature Coefficient which increases the electrical resistance with increasing temperature. The spark plug preferably further comprises an additional fixed ground electrode positioned closer to the center electrode than the plurality of ground electrodes. The plurality of ground electrodes preferably comprises six ground electrodes. Each of the upper portions of the ground electrodes preferably partially overlap the lower portion of the adjacent ground electrodes.

In a second aspect, a spark plug is disclosed. The spark plug comprises an insulating body having an open bore, a tubular conductive shell surrounding at least a portion of the insulating body, and a cylindrical center electrode positioned within the bore of the insulating body, the center electrode having a central longitudinal axis, the center electrode protruding from the insulating body forming a terminal end portion adapted to act as a spark generating portion. The spark plug further comprises a plurality of cylindrical, rectangular or triangular ground electrodes surrounding the center electrode, each ground electrode having a base end coupled to the conductive shell and an upper portion forming a generally curved path having a generally constant radial spark gap distance from the center electrode and extending partially along the longitudinal axis, the ground electrodes surrounding the center electrode in a circumferentially overlapping manner. The spark generating portion of the center electrode and the upper portions of the ground electrodes form a three-dimensional spark target volume. The spark target volume is up to approximately 100 cubic millimeters.

In a second preferred embodiment, one of the plurality of ground electrodes comprises a bi-metal structure configured to move radially away from the center electrode with increased temperature. One of the plurality of ground electrodes preferably comprises a conductor having a Positive Temperature Coefficient which increases the electrical resistance with increasing temperature. The spark plug preferably further comprises an additional fixed ground electrode positioned closer to the center electrode than the plurality of ground electrodes. The plurality of ground electrodes preferably comprises six ground electrodes.

In a third aspect, a spark plug is disclosed. The spark plug comprises a cylindrical center electrode having a central longitudinal axis, the center electrode forming a terminal end portion adapted to act as a spark generating portion, and a plurality of ground electrodes surrounding the center electrode forming a three-dimensional spark target volume, each ground electrode having a base and an upper portion forming a generally curved path having a generally constant radial spark gap distance from the center electrode and extending partially along the longitudinal axis.

In a third preferred embodiment, the spark target volume is up to approximately 100 cubic millimeters. The spark target volume preferably comprises a generally open volume adopted for allowing free propagation of fuel burn. Each of the upper portions of the ground electrodes preferably partially overlap the lower portion of the adjacent ground electrodes.

The present invention has other objects and features of advantage which will be more readily apparent from the following description of the preferred embodiments of carrying out the invention, when taken in conjunction with the accompanying drawings.

DESCRIPTION OF THE DRAWINGS

FIGS. 6A-6C are schematic views of a conventional platinum spark plug, a conventional iridium spark plug, and one or more embodiments of the Intelligent spark respectively illustrating the relative spark target volume for each of the three types of plugs.

FIG. 7 is a bottom view depicting that a spark produced by the new Intelligent spark plug tends to "hunt" into a fuel rich environment.

FIG. 26 is a chart comparing performance of one or more embodiments of the Intelligent spark to conventional spark plugs.

DETAILED DESCRIPTION OF THE PREFERRED EMBODIMENTS

In one or more embodiments, a spark plug comprises multiple ground electrodes surrounding a center electrode forming a large, three-dimensional spark target volume. The ground electrodes extend from the base of the spark plug and are twisted around the center electrode to provide a plurality of substantially equidistant spark points relative to the center electrode. The spark points are formed in parallel and around the elongated axis of the spark plug. This configuration enables a spark to be created where the localized concentration of fuel to air is richer.

Figure 4:
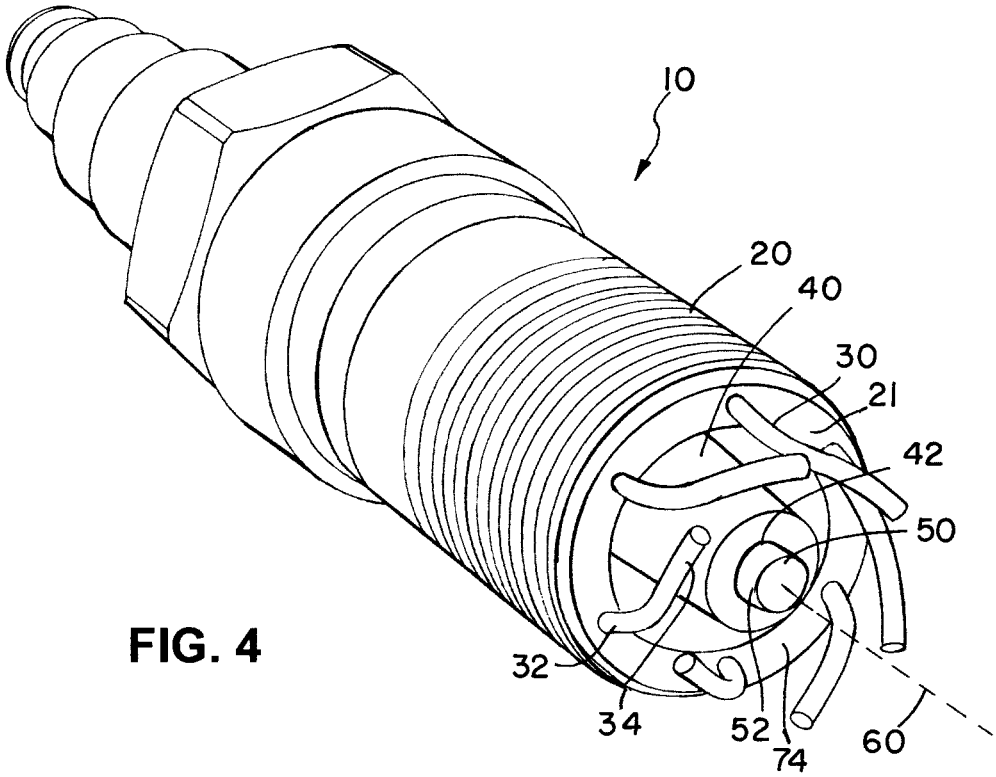
FIG. 4 is a perspective view of a new Intelligent spark plug in one or more embodiments.

FIG. 4 shows a prototype of a new Intelligent spark plug 10 made according to a presently preferred embodiment. As shown, the Intelligent spark plug 10 uniquely has a plurality of ground electrodes 30, here six, that extend from a bottom surface 21 of the spark plug's base 20 and overlapping twist around the spark plug's center electrode 50. This unique configuration for the ground electrodes 30 provides a plurality of substantially equidistant spark points, relative to the center electrode 50, both in parallel with and around an elongated longitudinal axis 60 of the spark plug 10. The new design creates an infinite number of sparking paths, of a cylindrical or toroidal shape, around the center electrode 50 in the center region of the combustion chamber, without shielding the sparking area for the rest of the combustion chamber. One or more embodiments provide for an improved spark plug that automatically creates a high tension voltage jump that more efficiently ignites the unevenly mixed fuel/air mixture associated with the "stop and go" type of city driving.

Figure 5:
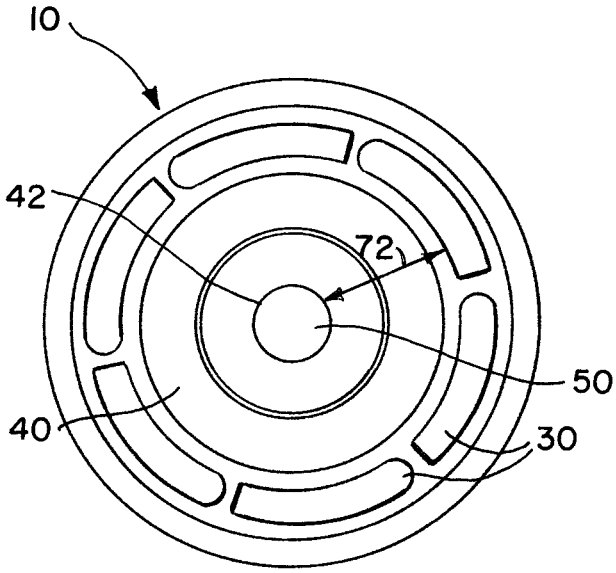
FIG. 5 is a bottom view of the new Intelligent spark plug in one or more embodiments.

FIG. 5 is a bottom view of the new Intelligent spark plug 10, which shows how the ground electrodes 30 overlapping twist around the spark plug's center electrode 50 in one or more embodiments. This unique arrangement essentially provides a large target area for the spark jump, while simultaneously providing a relatively unfettered propagation path for the fuel burn resulting from the spark. In essence, the overlapping ground electrodes 30 that twist around the center electrode 50 provide a cylindrical or toroidal target area, one that surrounds the center electrode and has a fair degree of length in parallel with the longitudinal axis 60 of the spark plug. The number of ground electrodes per plug may range from 2 through 10 or more in one or more embodiments.

The operation of the Intelligent spark plug 10 is based on a theory, confirmed by experimental observation, that the hydrocarbons in a richer fuel/air mixture provide an electrical path of least resistance for the spark. It is believed that new Intelligent spark plug 10 provides much greater efficiency and a more thorough burn at low revolutions per minute ("RPMs") because its configuration permits the spark to uniquely "hunt" for the richest zone of the fuel/air mixture. For engines operating below about 2,000 RPM, the fuel/air ratio is less uniform (i.e., homogenous) that at higher speeds. In such a case, the fuel/air mixture may be richer on one side of the cylinder than on the other. The new Intelligent spark plug 10 may help the most, therefore, for low RPMs, stop and go driving. It may also help increase efficiencies during the RPM drops associated with automatic transmission shifting.

As shown in FIGS. 5 and 6, in one or more embodiments, a spark plug 10 comprises an insulating body 40 having an open bore 42, and a spark plug base 20 (i.e., a tubular conductive shell) surrounding at least a portion of the insulating body 40. A cylindrical center electrode 50 is positioned within the bore 42 of the insulating body 40. The center electrode 50 has a central longitudinal axis 60, the center electrode 50 protruding from the insulating body forming a terminal end portion 52 adapted to act as a spark generating portion. The spark plug 10 also has a plurality of ground electrodes 30 surrounding the center electrode 50, each ground electrode having a base end 32 coupled to the conductive shell 20 and an elongated upper portion 34 extending from the base end to a distal end, forming a generally curved path and having an elongated inner surface at a generally constant radial spark gap distance 72 from the center electrode 50 and, while curving around, also extending partially along the longitudinal axis 60. As used herein and as is commonly used in the art, the terms "radial" and "radially" refers the directions or rays perpendicular to the longitudinal axis 60. In one or more embodiments, the curved path comprises a portion of a helix formed about the longitudinal axis 60 of the center electrode 50. In one or more embodiments, the ground electrodes 30 are cylindrically shaped rods. In one or more embodiments, the radial spark gap 72 is in the range of approximately 1.7 millimeters to approximately 4.75 millimeters.

In one or more embodiments, the spark generating portion 52 of the center electrode 50 and the upper portions 34 of the ground electrodes 30 form a three-dimensional spark target volume 74 (See FIG. 6C). The overlapping ground electrodes 30 that twist around the center electrode 50 provide a cylindrical or toroidal target area, one that surrounds the center electrode and has a fair degree of length in parallel with the long axis 60 of the spark plug 10. In one or more embodiments, the spark target volume 74 is approximately 100 $mm^3$ (cubic millimeters). The spark plug may comprise a plurality of cylindrical, rectangular or triangular ground electrodes 30 surrounding the center electrode 50 in one or more embodiments, As seen in FIGS. 5 and 6, the spark target volume 74 comprises an generally open volume adopted for allowing free propagation of fuel burn, as the number and dimensional size of the electrodes provide a large amount of open, unobstructed space for the fuel/air mixture to enter the spark target volume and for the fuel burn to propagate unfettered.

FIGS. 6A-6C are schematic views of a conventional platinum spark plug 110*a*, a conventional iridium spark plug 110*b*, and an embodiment of the Intelligent spark plug 10 respectively illustrating the relative spark target volume for each of the three types of plugs. The conventional spark plugs depicted in FIGS. 6A and 6B show that the spark target volume is general a small cylinder having a narrow diameter and a short height. Calculations suggest that the spark target volume for the conventional spark plug is about 4 cubic millimeters, and is about 0.4 cubic millimeters for the Iridium spark plug. The Intelligent spark target volume 74 is calculated to be about 100 cubic millimeters, which is 25 and 250 times greater than the conventional and the Iridium spark plug respectively. Embodiments of the Intelligent spark plug are able to strike 360 degrees around the center electrode in a volume that is 20-100 times that of conventional spark plugs. Embodiments sense where the fuel-air mixture is richer (in fuel) and strikes at that precise point. The resulting fast and complete combustion leads to high power, low fuel consumption, and a huge reduction or even elimination of harmful emissions.

Figure 1:
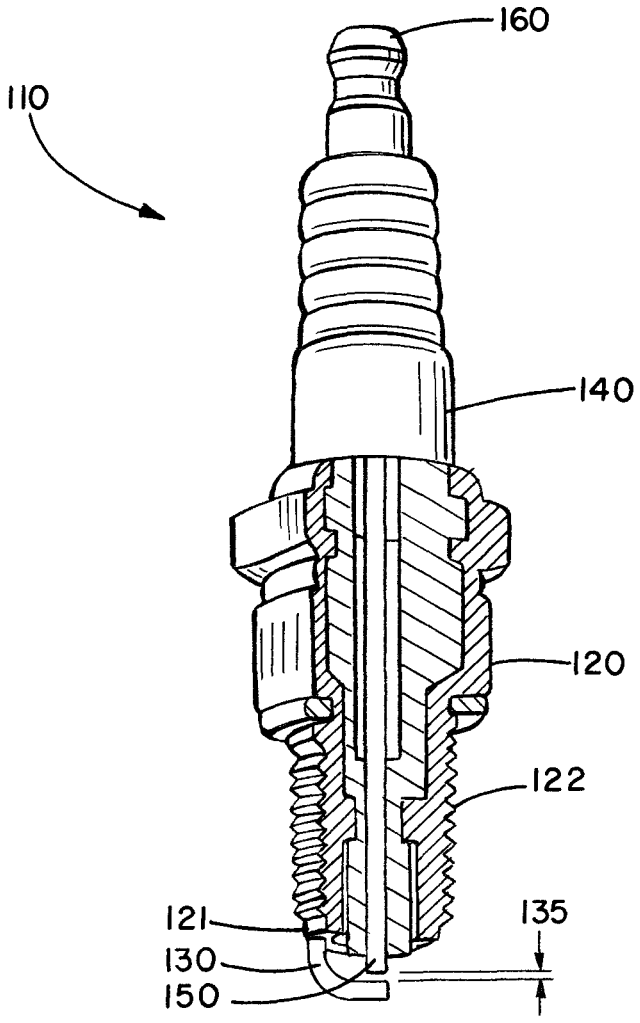
FIG. 1 Prior Art
FIG. 1 is side, cross-sectional view of a prior art spark plug having a single J-type ground electrode.
Figure 2:
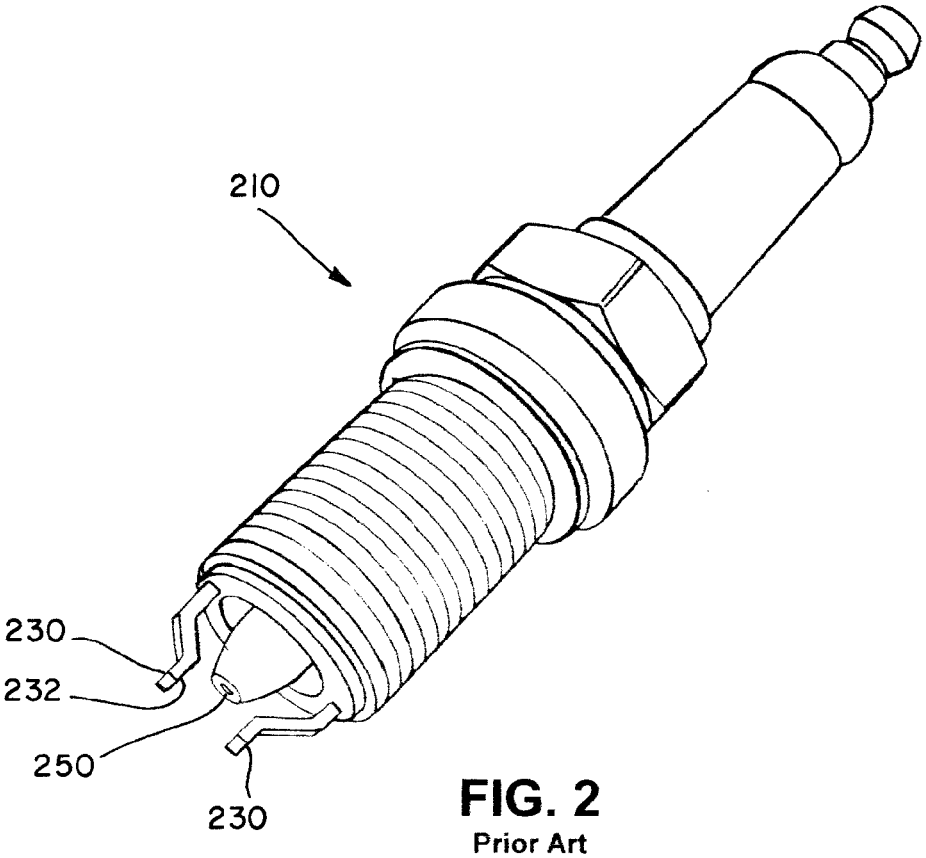
FIG. 2 Prior Art
FIG. 2 is a front, perspective view of a prior art spark plug having two ground electrodes.
Figure 3:
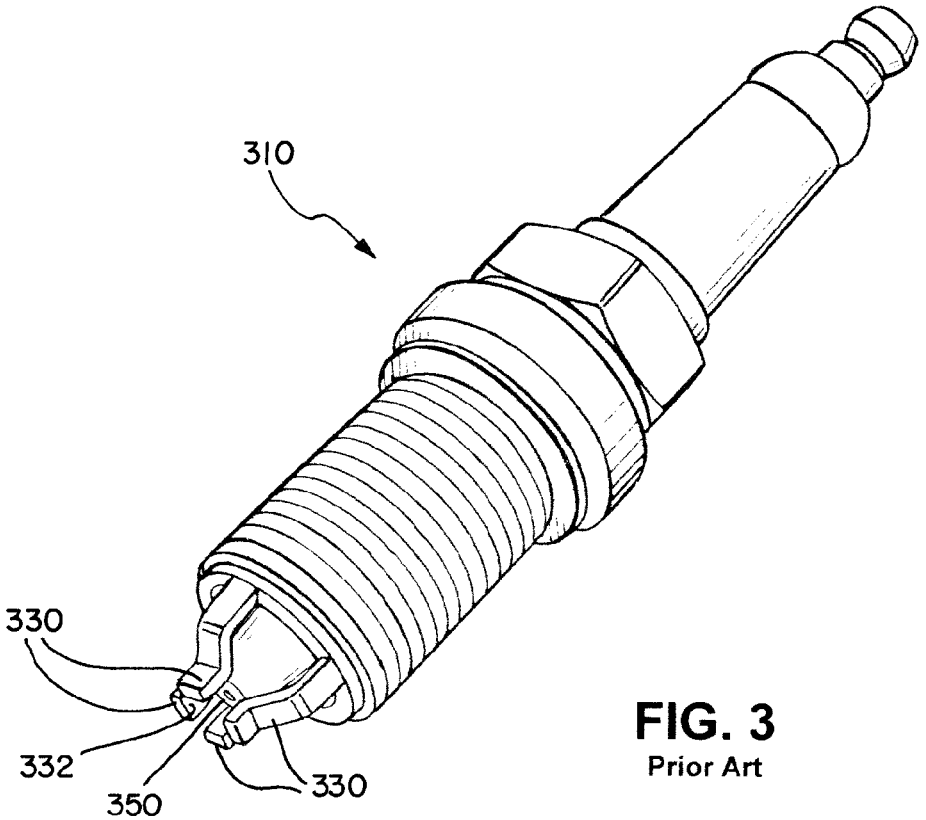
FIG. 3 Prior Art
FIG. 3 is a front, perspective view of a prior art spark plug having four ground electrodes.

Referring back to FIGS. 2 and 3, the spark target volume for spark plugs 210 and 310 are not expected to have the large spark target volumes exhibited by the Intelligent spark plug 10. For example, the ground electrodes 230 of spark plug 210 terminate with a flat surface 232 adjacent to the center electrode 250, where the surface area of the flat surface is similar to that of the ground electrode 130 of conventional spark plug 110. The ground electrodes 230 are not configured to twist around the center electrode 250 and therefore do not provide a cylindrical or toroidal target area. This is likewise true for spark plug 310, which has four electrodes 330 with flat surfaces 332. Hence, the spark plugs 210 and 310 do not form the large spark target volume of the Intelligent spark plugs 10.

FIG. 7 shows a depiction of a butane lighter 90 showing the efficacy of one or more embodiments of an Intelligent spark plug 10 according to a first preferred embodiment. An embodiment of the spark plug 10 is being repeatedly driven by an ignition source to generate a spark 11 between its center electrode 50 and a varying one of its plurality of circumferentially extending ground electrodes 30. In this confirmatory experiment, a butane lighter 90 and its associated flame 91 are moved around the driven spark plug 10 and one can observe that the spark 11 will jump toward a ground electrode 30 that is in the vicinity of the richer fuel/air mixture provided by the flame 91.

Figure 8:
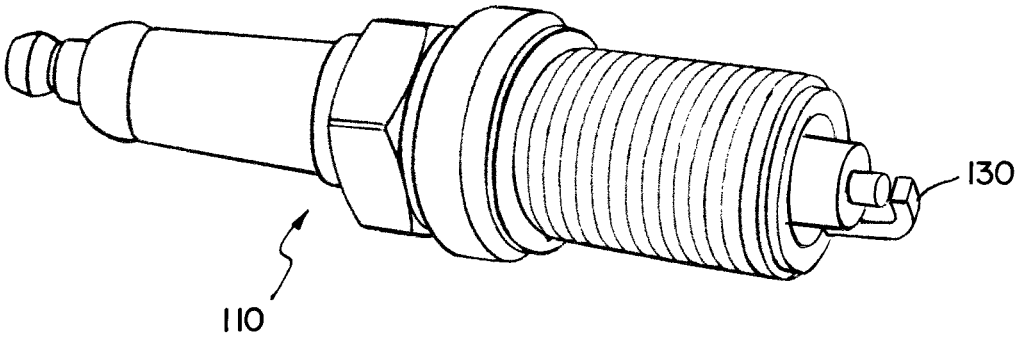
FIG. 8 is a side, perspective view of a conventional spark plug before modifications are made to adapt the plug into an Intelligent spark plug.
Figure 9:
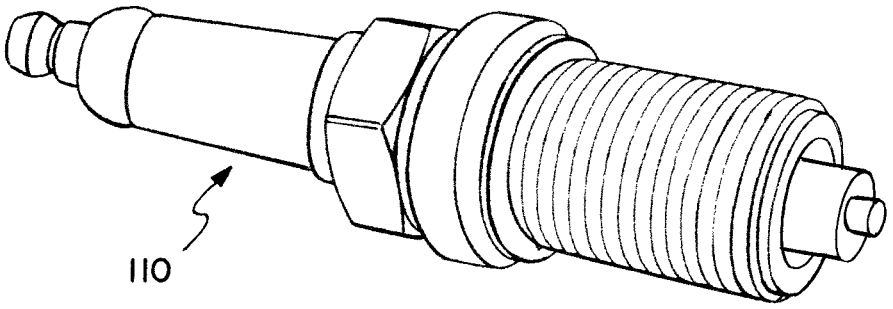
FIG. 9 is a side, perspective view of the conventional spark plug with the ground electrode removed.
Figure 10:
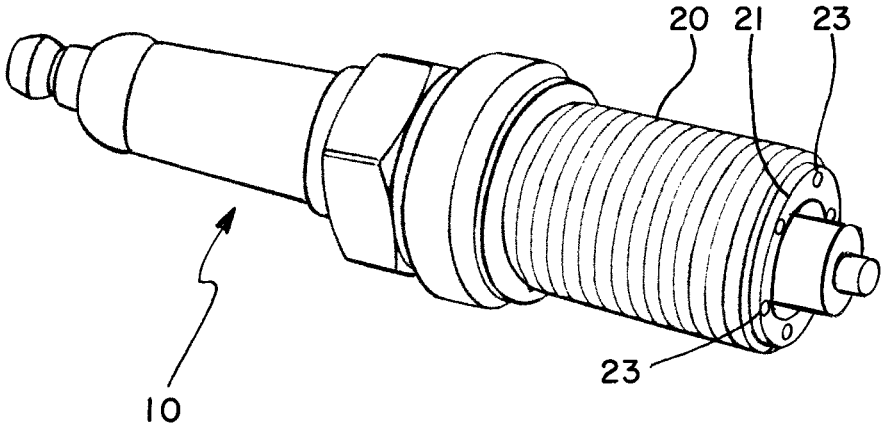
FIG. 10 is a side, perspective view of the conventional spark plug have six holes milled in the spark plug shell in one or more embodiments.
Figure 11:
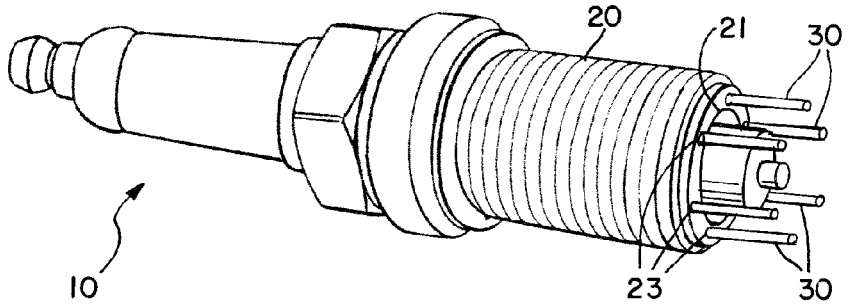
FIG. 11 is a side, perspective view of six rods positioned in the six milled holes.
Figure 12:
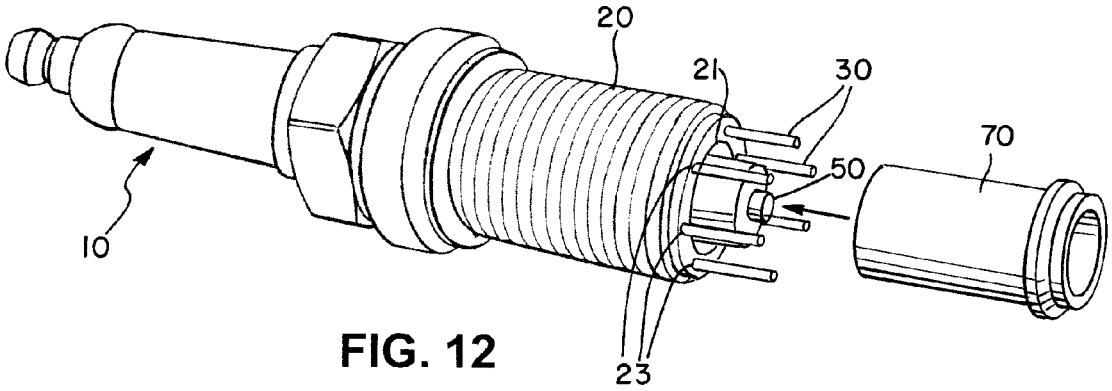
FIGS. 12 and 13 are side, perspective views of the spark plug receiving an alignment ferrule in one or more embodiments.
Figure 13:
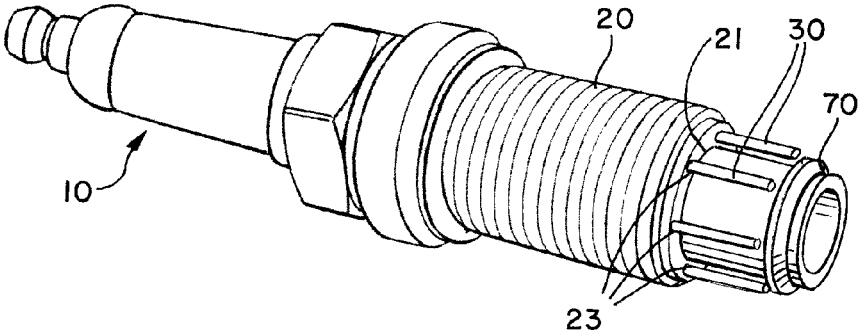
Figure 14:
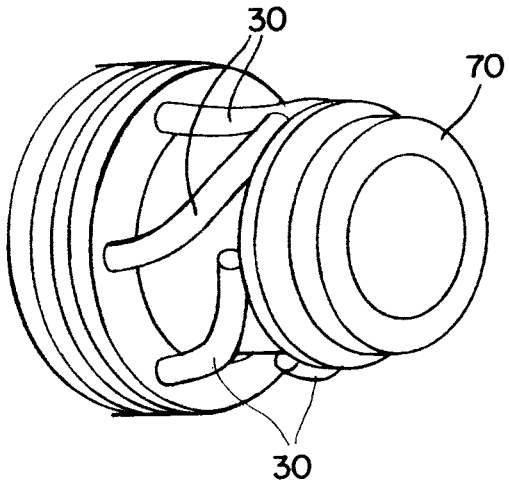
FIG. 14 is a side, perspective view of the rods formed and twisted around the alignment ferrule.
Figure 15:
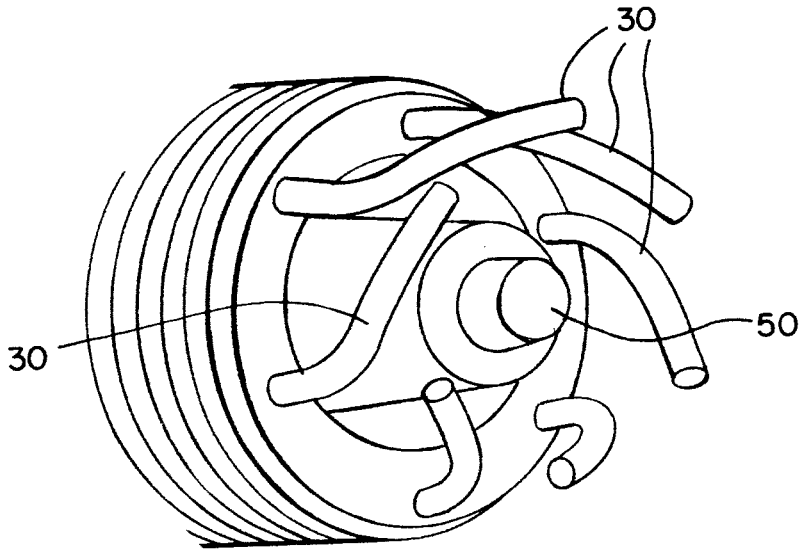
FIG. 15 is a side, perspective view of the Intelligent spark plug with the ferrule removed in one or more embodiments.

FIGS. 8-15 depict an exemplary process for fabricating one or more embodiments of the Intelligent spark plug 10. The presently preferred Intelligent plug was fabricated by removing the conventional J-type ground electrode 130 from a regular spark plug 110, precision drilling six holes 23 in the bottom face 21 of its base 20. And then welding in six rods 30 that will function as ground electrodes 30. Specifically, FIG. 8 shows the fabrication beginning with a conventional spark plug 110 having a J-type ground electrode 130. FIG. 9 shows the spark plug 110 after its J-type ground electrode 130 has been removed. FIG. 10 shows the spark plug 10 (it no longer being conventional) after six holes 23 have been precision drilled into the bottom face 21 of its base 20. FIG. 11 shows the spark plug 10 after six rods 30 that will function as the ground electrodes 30 have been inserted and welded into the six holes 23. FIG. 12 shows a ferrule 70 being positioned into the annular space between the six rods 30 and the center electrode 50. FIG. 13 shows the six rods 30 surrounding the ferrule 70 while still straight. FIG. 14 shows the six rods 30 after they were bent around the ferrule 70 to form the ground electrodes 30 that surround the center electrode in a circumferentially overlapping manner. FIG. 15 shows the six ground electrodes 30 at the bottom of the new Intelligent spark plug 10 with the ferrule 70 removed.

Figure 16:
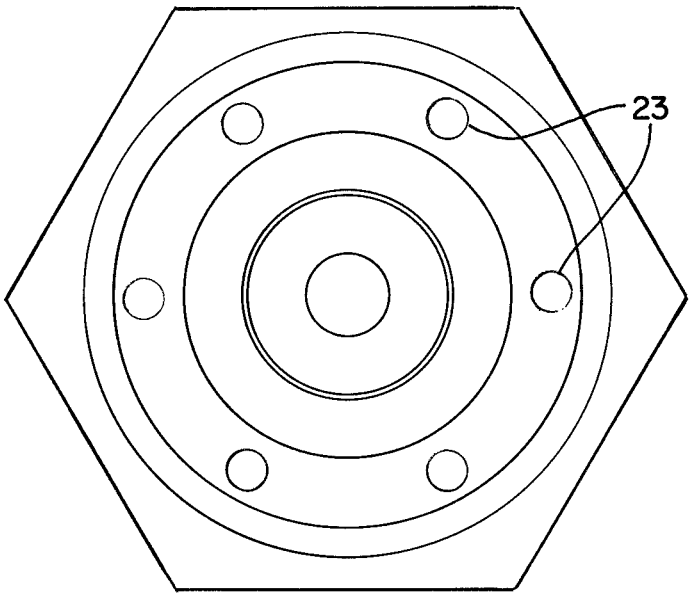
FIGS. 16 and 17 are a bottom and side view respectively of schematics illustrating manufacturing details for the manufacture of a six-rod Intelligent spark plug in one or more embodiments.
Figure 17:
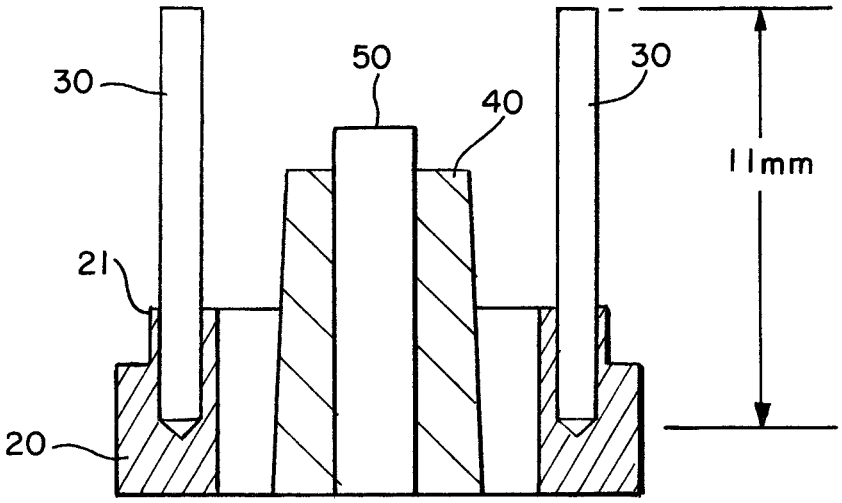

FIGS. 16 and 17 provide presently preferred manufacturing details for a six-rod Intelligent spark plug 10. The ground electrode 30 measures 11 millimeters in an embodiment, and is embedded into bottom surface 21 through holes 23. FIG. 17 shows center conductor 50 positioned within the insulating body 40, which is positioned within the spark plug base 20.

Figure 18A:
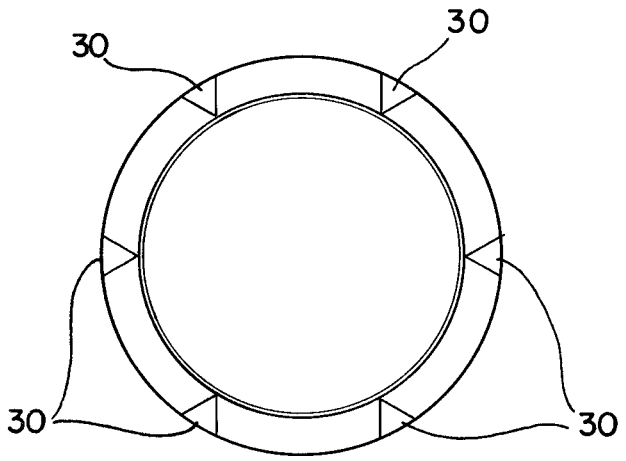
FIGS. 18A and 18B are a bottom and side view respectively of schematics illustrating manufacturing details for the manufacture of a six-rod Intelligent spark plug employing an insert in one or more embodiments.
Figure 18B:
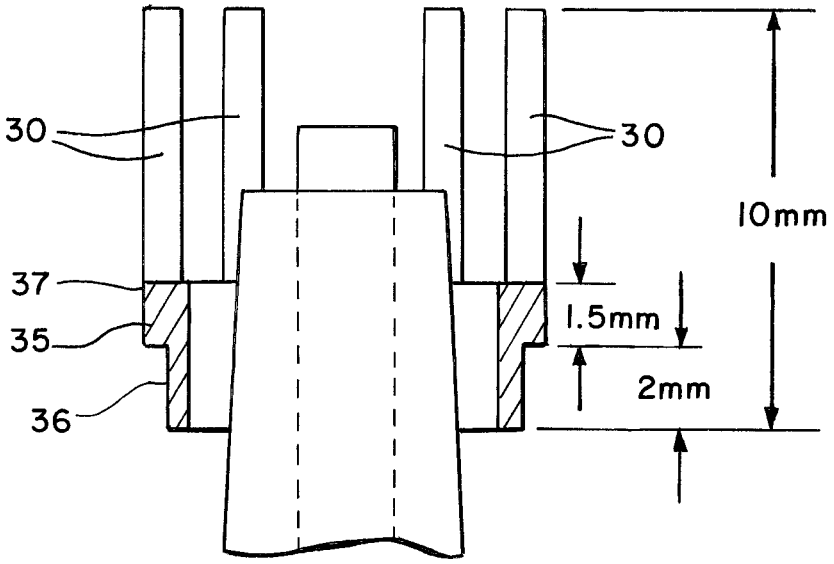

FIGS. 18A and 18B illustrate an "insert-method" approach to manufacturing an alternative version of a six-rod Intelligent spark plug 10. Here, an insert 35 having six rods 30 is used. The insert 35 would be fabricated from stainless steel pipe, or tubing, and could be attached to any existing spark plug after removing its electrode. Welding the insert 35 in at a few points should be less expensive than the current method of welding six rods 30 completely around each rod, after precision drilling six holes in every spark plug. The insert 35 comprises a lower portion 36, and an insert shoulder 37 having a larger outer diameter in an embodiment. The lower portion 36 has a height of 2 millimeters, the insert shoulder has a height of 1.5 millimeters, and the distance from the bottom of the insert to the top of ground electrodes 30 measures 10 millimeters in an embodiment. After welding the insert the rods 30 will be bent around the ferrule 70 to form the ground electrodes 30 that surround the center electrode in a circumferentially overlapping manner.

Figure 19B:
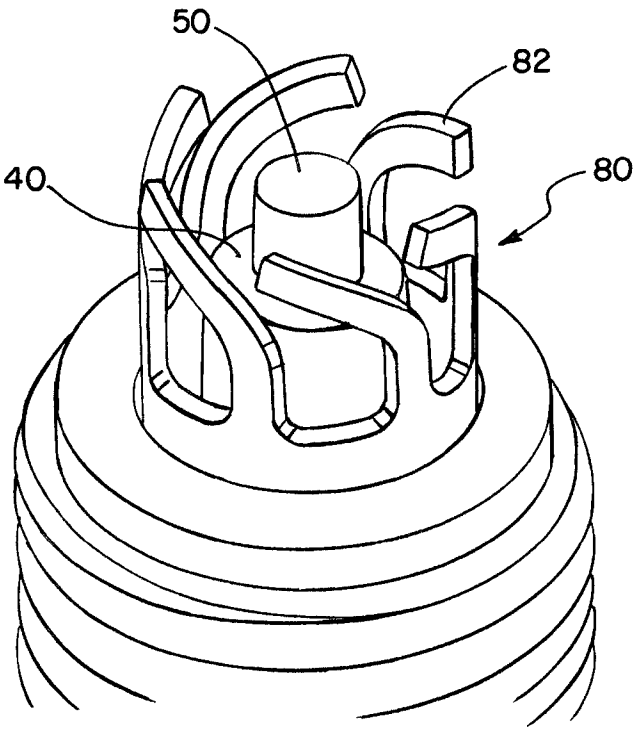
FIG. 19B is a perspective view of the insert positioned in a spark plug.
Figure 19A:
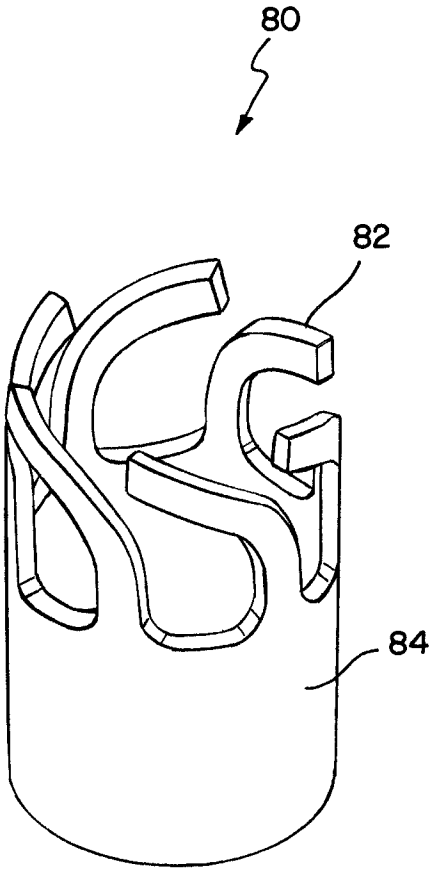
FIG. 19A is a perspective view of an insert in an embodiment.

FIG. 19A is a perspective view of a one-piece insert 80 in one or more embodiments. The insert 80 comprises a hollow cylindrical base 84 and a plurality of ground electrodes 82. FIG. 19B is a perspective view of the insert 80 positioned in a spark plug. The cylindrical base 84 is positioned around the insulating body 40 and makes electrical contact with the conductive spark plug shell. The ground electrodes 82 extend from the cylindrical base 84 and overlapping twist around the spark plug's center electrode 50. This unique configuration for the ground electrodes 82 provides a plurality of substantially equidistant spark points, relative to the center electrode 50, both in parallel with and around an elongated longitudinal axis of the spark plug. The new design creates an infinite number of sparking paths, of a cylindrical or toroidal shape, around the center electrode 50 in the center region of the combustion chamber, without shielding the sparking area for the rest of the combustion chamber.

Figure 20:
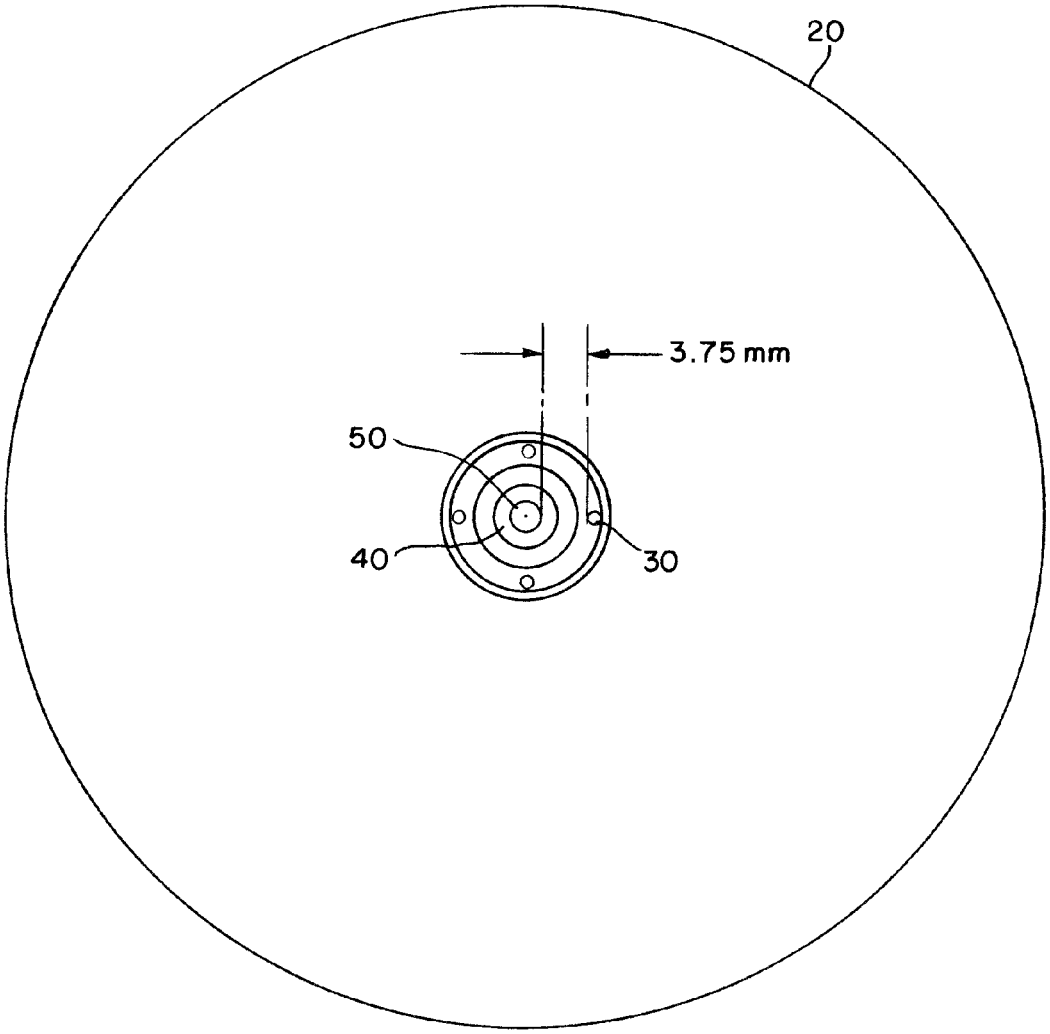
FIGS. 20 and 21 show a spark gap dimension/volume perspective for an Intelligent spark plug with a regular center electrode, when viewed from inside the piston in one or more embodiments.
Figure 21:
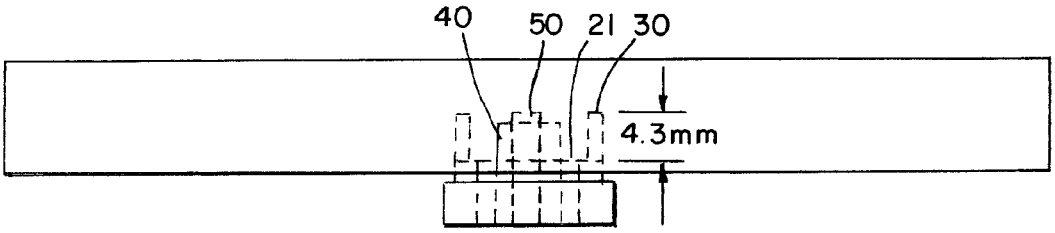

FIGS. 20 and 21 show a spark gap dimension/volume perspective for an Intelligent spark plug with a regular center electrode, when viewed from inside the piston in one or more embodiments. The spark gap for the embodiment depicted in FIG. 20 is 3.75 millimeters. The height of the ground electrode 30 extending from the bottom surface 21 is 4.3 millimeters in an embodiment.

Figure 22:
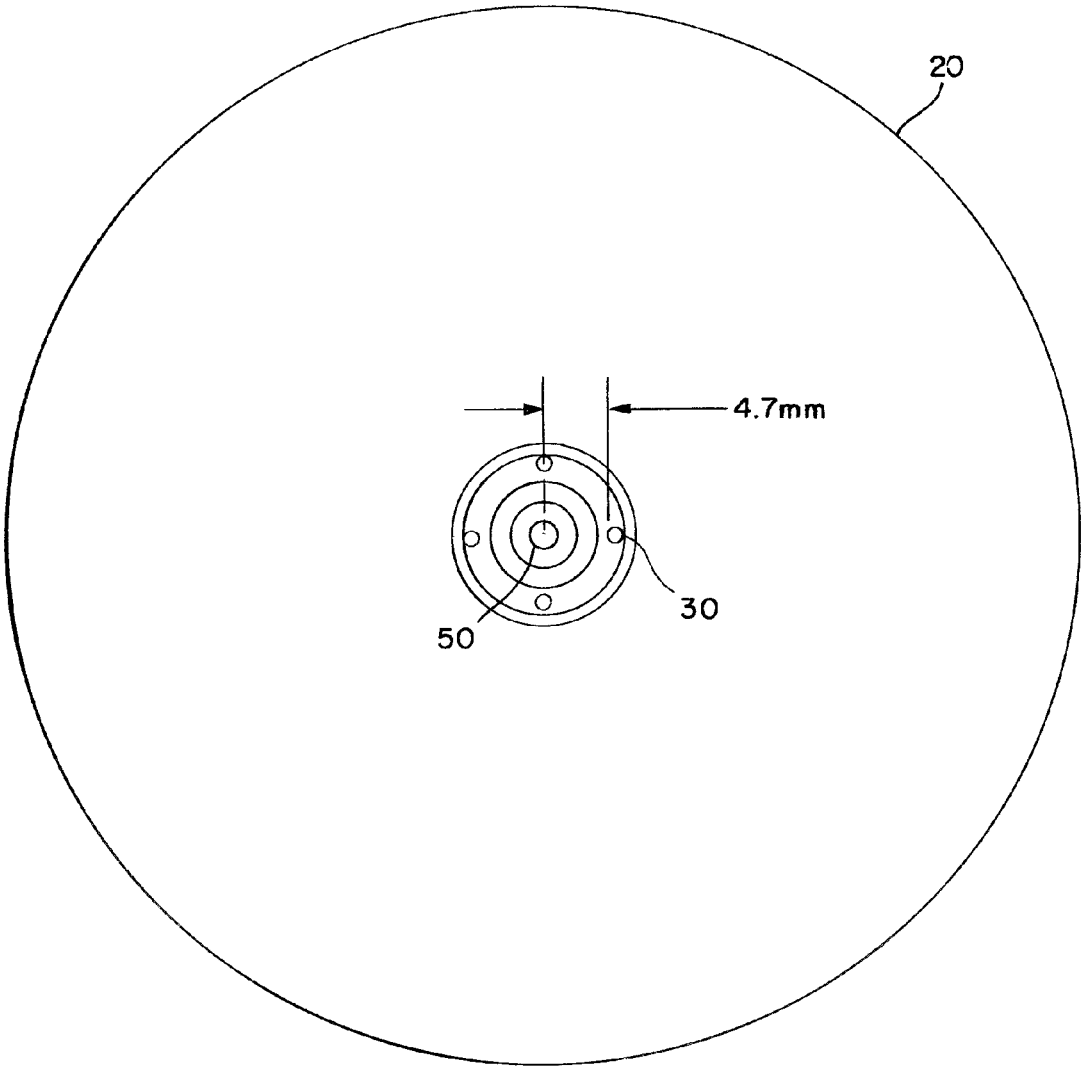
FIGS. 22 and 23 show a spark gap dimension/volume perspective for an Intelligent spark plug with a small center electrode, when viewed from inside the piston in one or more embodiments.
Figure 23:
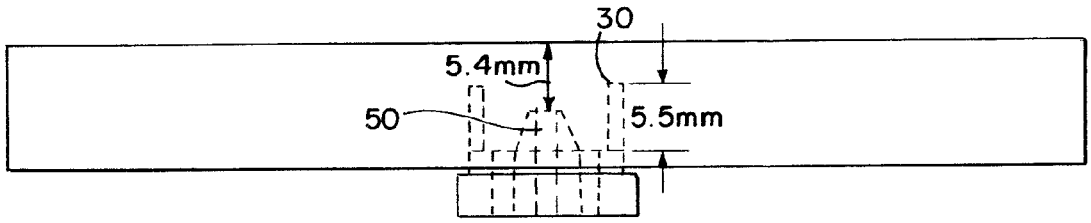

FIGS. 22 and 23 show a spark gap dimension/volume perspective for an Intelligent spark plug with a small center electrode, when viewed from inside the piston in one or more embodiments. The distance from the center of the center electrode 50 to the elongated inner surface of the electrodes 30 is 4.7 millimeters, and the height of exposed ground electrode 30 is 5.5 millimeters in an embodiment.

Figure 24:
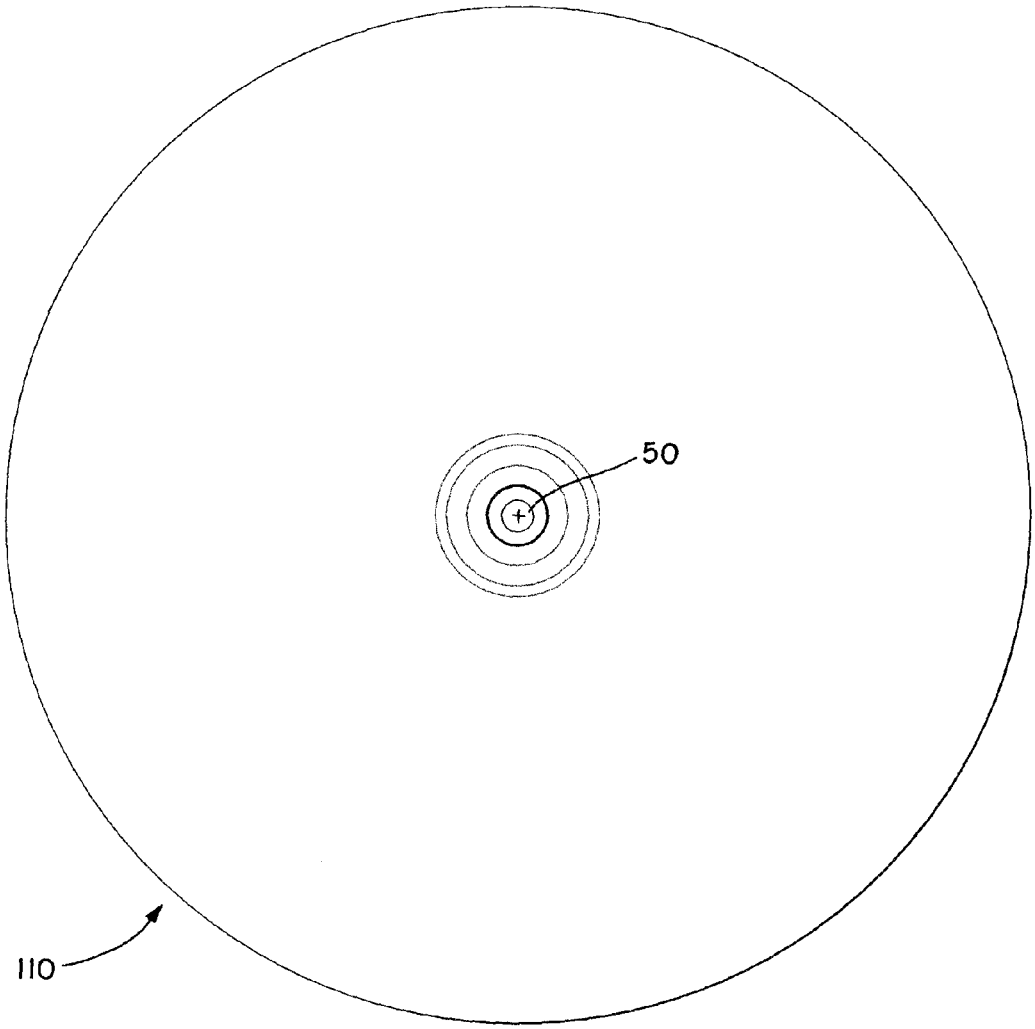
FIGS. 24 and 25 show a spark gap dimension/volume perspective for a regular spark plug, the majority of the existing spark plugs, when viewed from inside the piston.
Figure 25:
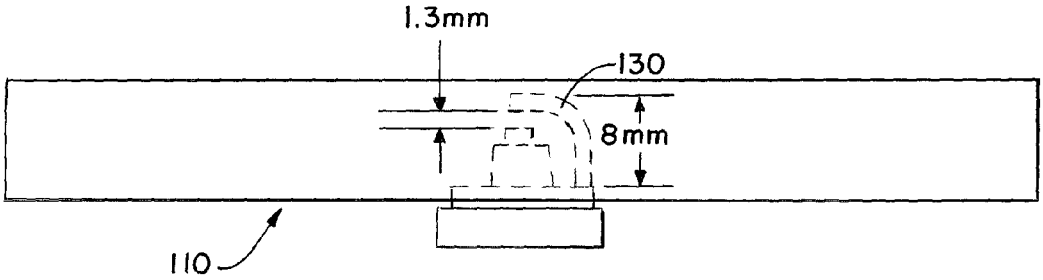

FIGS. 24 and 25 show a spark gap dimension/volume perspective for a regular spark plug 110, the majority of the existing spark plugs, when viewed from inside the piston. The ground electrode 130 extends 8 millimeters from the plug, and forms a spark gap of 1.3 millimeters for example.

Several tests were made comparing the performance of automobiles using conventional and Intelligent Spark plugs. The tests included comparing pollution emissions, fuel economy, and engine performance for several automobiles. Embodiments of the Intelligent spark plug may reduce the emission of air pollution from internal combustion engines.

Cars, scooters, motorbikes, electric power generators, and power tools are very useful but come with a price in the form of emissions and air pollution. In 1967 the State of California created the California Air Resources Board to fight car air pollution. In 1970, the United States Federal government created the United States Environmental Protection Agency (EPA). Today most of the countries around the world regulate car emission to be measured and to meet specified values. Reducing or eliminating pollution is important for reducing the effects of climate change, as some believe that climate change may force 1 out of every 13 species to extinction on average if left unchecked.

Many countries have adopted anti-pollution measures. In Germany since 2010, Berlin has an "ecological area" in the city center where only vehicles with appropriate stickers indicating low emission may enter. In Britain, a congestion toll was implemented in London city center since 2003. In Greece since 1982, an alternating traffic system is employed in Athens. In Italy, since the 1990s, an alternating traffic system in Rome and restricted traffic areas in historic center are employed. In Portugal, there are some restricted traffic areas in the historic town center of Lisbon for vehicles manufactured before 2000. In Scandinavia, there is a congestion toll in Sweden, bike paths in Denmark, and congestion tolls and electric cars in Norway. In Paris, the French capital on Mar. 23, 2015 adopted an emergency traffic-limiting measure to reduce pollution in the Paris sky, using an alternating traffic system which stops one in every two cars, scooters, or motorcycles entering the capital city.

Internal combustion engines emit $CO_2$ (Carbon Dioxide) which is not directly harmful, but produces global warming, HC (unburned Hydrocarbons) which is a major contributor to smog and is linked to asthma, liver disease, lung disease, and cancer, CO (Carbon Monoxide) which reduces the blood's ability to carry oxygen and overexposure is fatal, and NO (Nitrogen Oxides) which is a precursor to smog and acid rain and may destroy resistance to respiratory infection.

Several tests were performed on multiple cars to investigate the performance of automobiles equipped with embodiments of the Intelligent spark plug. In a first test, a pollution reduction evaluation test was performed on a 2002 CHRYSLER CONCORDE® 2.7 Liter V6 engine at a California Smog Check Station. The same car was tested twice. In one test, conventional spark plugs were installed, and in the second test, Intelligent spark plugs were installed.

Tables I and II below present the emission test results for the automobile installed with conventional spark plugs and Intelligent spark plugs respectively.

TABLE I

Emission Results With Market Leading Spark Plugs

| Test | RPM | % CO2 | % O2 | HC (PPM) | CO (%) | NO (PPM) |
|---|---|---|---|---|---|---|
| M1: 15 MPH | 1628 | 15.0 | 0.2 | 50 | 0.09 | 387 |
| M2: 25 MPH | 1664 | 15.0 | 0.1 | 4 | 0.00 | 49 |

TABLE II

Emission Results with Intelligent Spark Plugs

| Test | RPM | % CO2 | % O2 | HC (PPM) | CO (%) | NO (PPM) |
|---|---|---|---|---|---|---|
| M1: 15 MPH | 1684 | 14.9 | 0.1 | 6 | 0.00 | 52 |
| M2: 25 MPH | 1669 | 15.0 | 0.1 | 0 | 0.00 | 9 |

Figure 27:
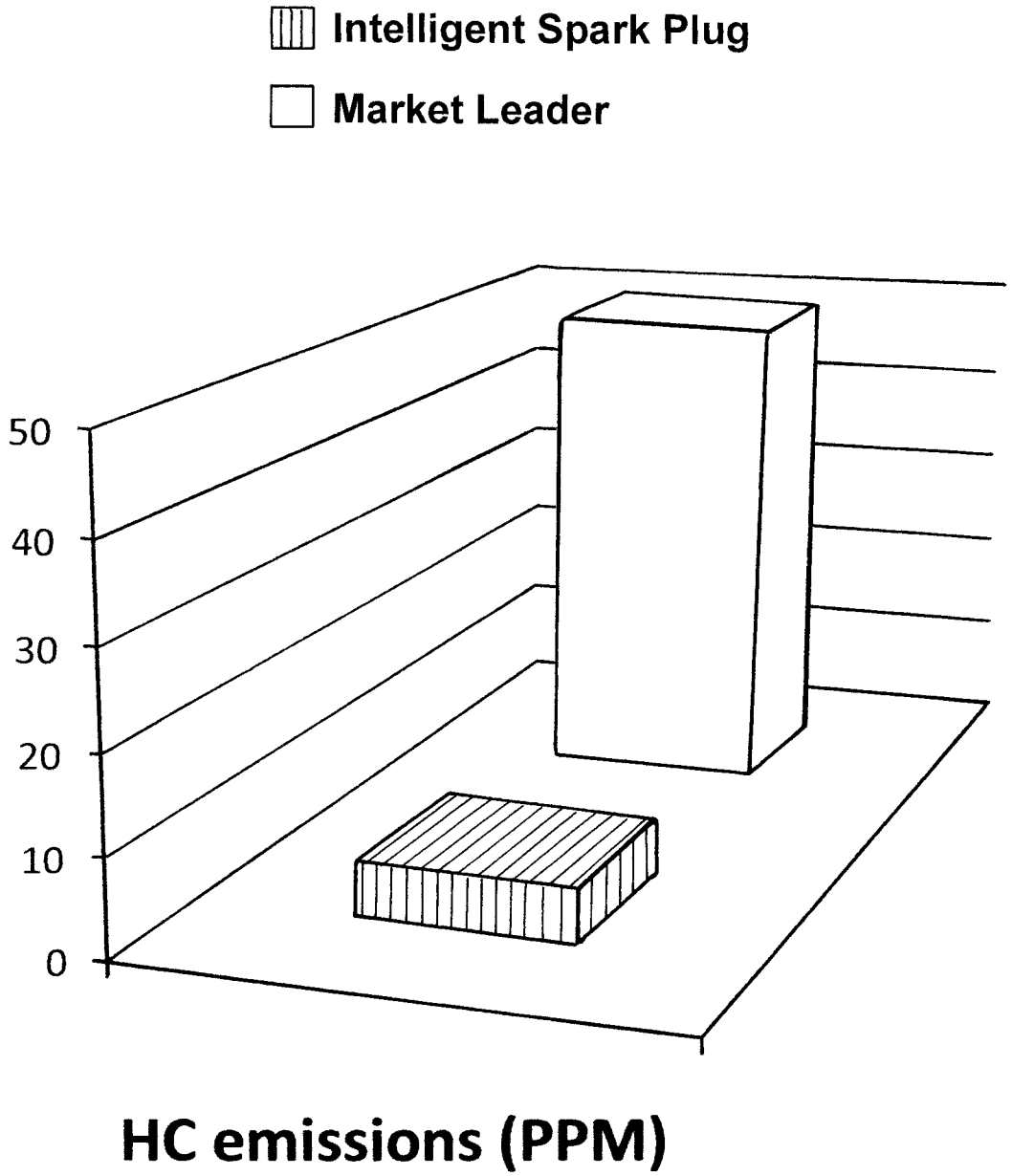
FIG. 27 is a bar graph comparing the Hydrocarbon emissions of embodiments of the Intelligent spark plug against conventional spark plugs.
Figure 28:
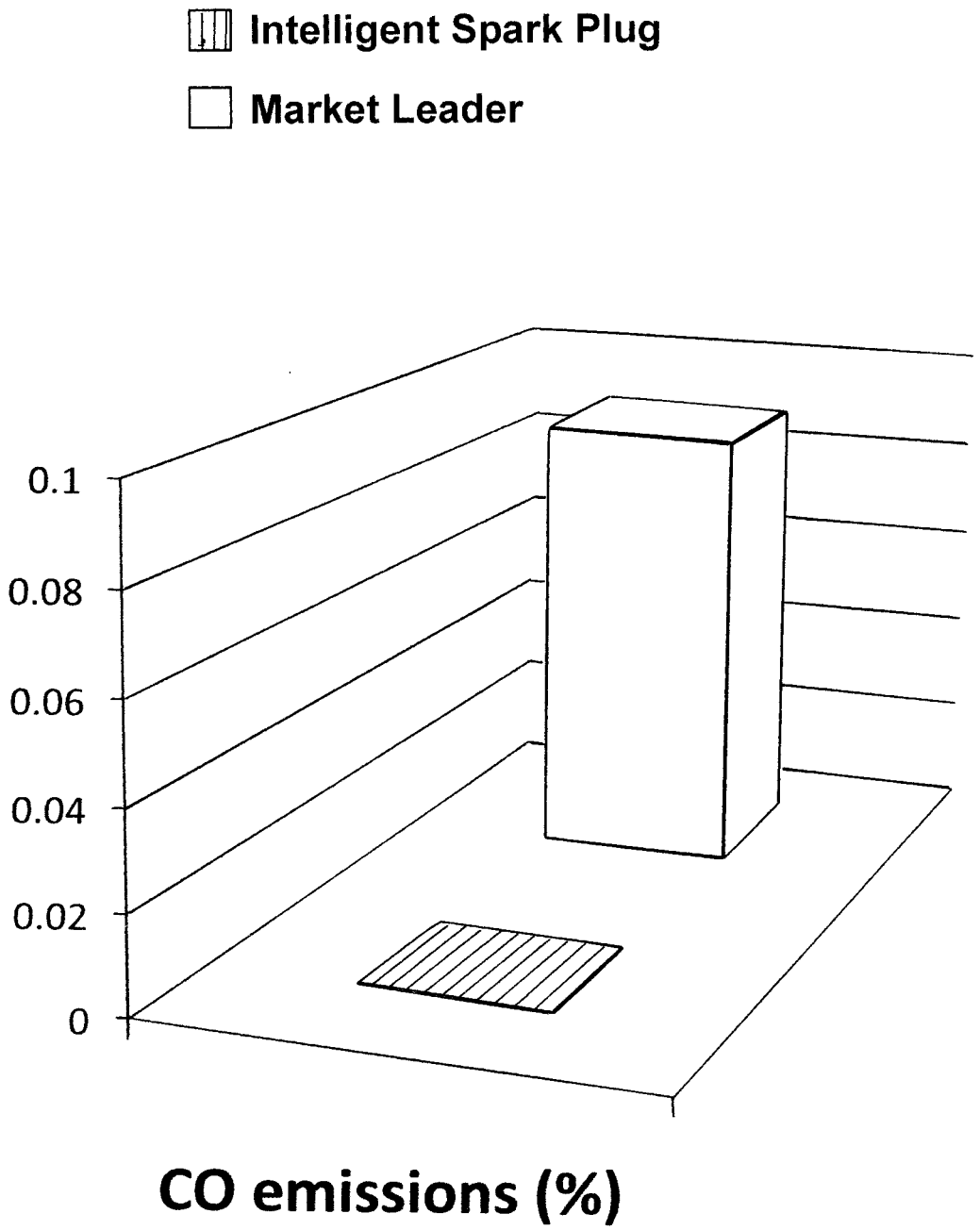
FIG. 28 is a bar graph comparing the Carbon Monoxide emissions of embodiments of the Intelligent spark plug against conventional spark plugs.
Figure 29:
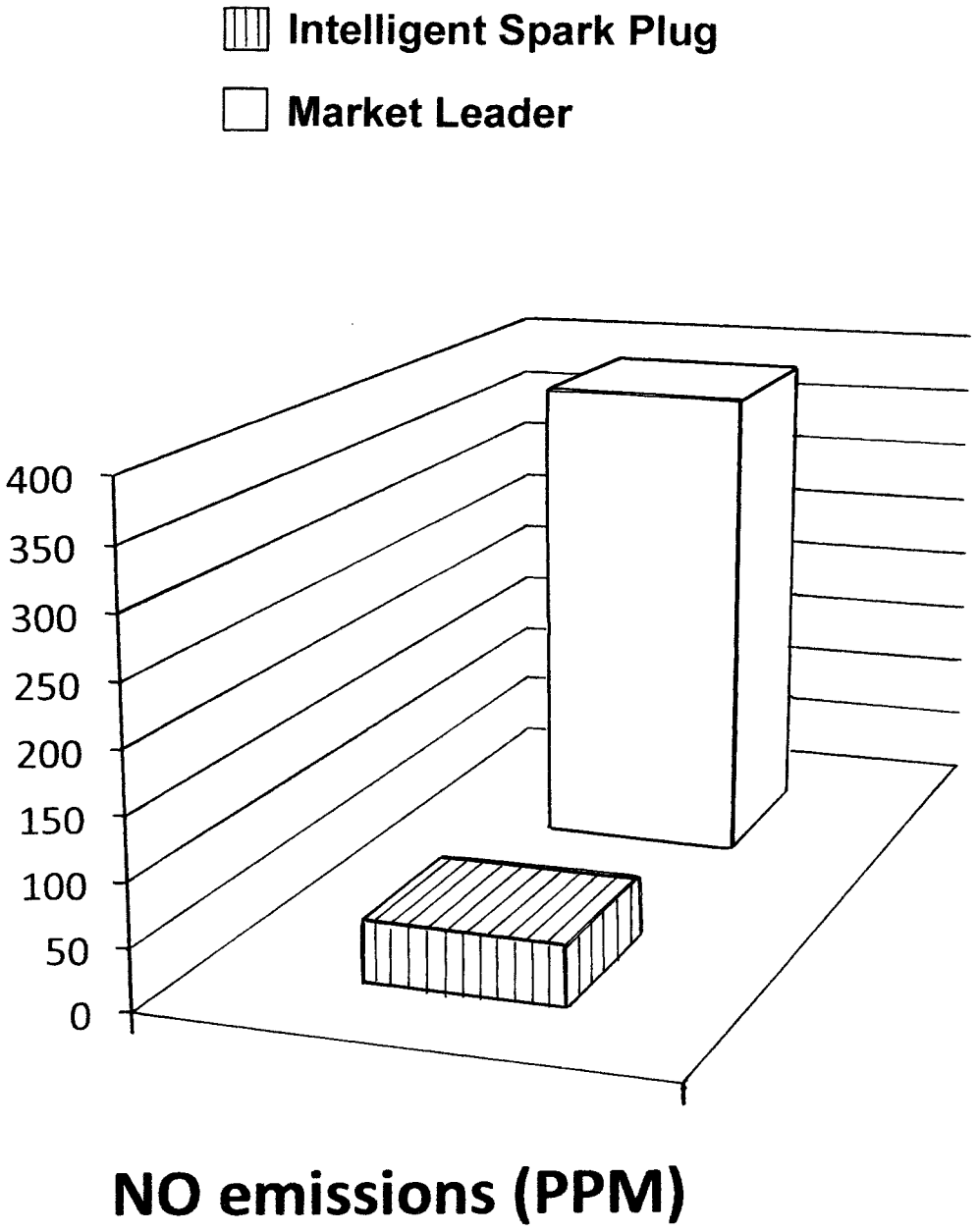
FIG. 29 is a bar graph comparing the Nitrogen Oxide emissions of embodiments of the Intelligent spark plug against conventional spark plugs.

FIG. 26 presents a chart summarizing the test results. The chart lists the emission results for Hydrocarbons, Carbon Monoxide, and Nitrogen Oxides for the car outfitted with conventional spark plugs and the car outfitted with Intelligent spark plugs. In this test, the automobile having embodiments of the Intelligent Spark Plug outperformed the automobile running conventional spark plugs with respect to emission of Hydrocarbons, Carbon Monoxide, and Nitrogen Oxides. FIG. 27 presents the improvement in reduced HC emissions (PPM) in 3D bar graph format. FIG. 28 presents the improvement in reduced CO emissions (%) in 3D bar graph format. FIG. 29 presents the improvement in reduced NO emissions (PPM) in 3D bar graph format.

In summary, embodiments described herein have been shown to outperform conventional spark plugs with respect to HC emission (>800% improvement), CO (>900% improvement), and NO (>700% improvement). The average improvement in emissions is 8 times better. The typical differences in pollution emission between differing brands of conventional spark plugs may be between 5% and 10%.

A second test was performed to determine the increase in fuel efficiency for engines employing embodiments of the spark plugs installed in a 2014 TOYOTA CAMRY® 2.5 Liter, 4 cylinder gasoline engine. This car has an EPA Highway rating of 35 miles per gallon ("MPG") at an average speed of 48.3 MPH and a top speed of 60 MPH. The EPA City rating for this car is 25 MPG at an average speed of 21.2 MPH and a top speed of 56.7 MPH. The combined EPA rating is 28 MPG. A user's average is 27.3 MPG.

Figure 30:
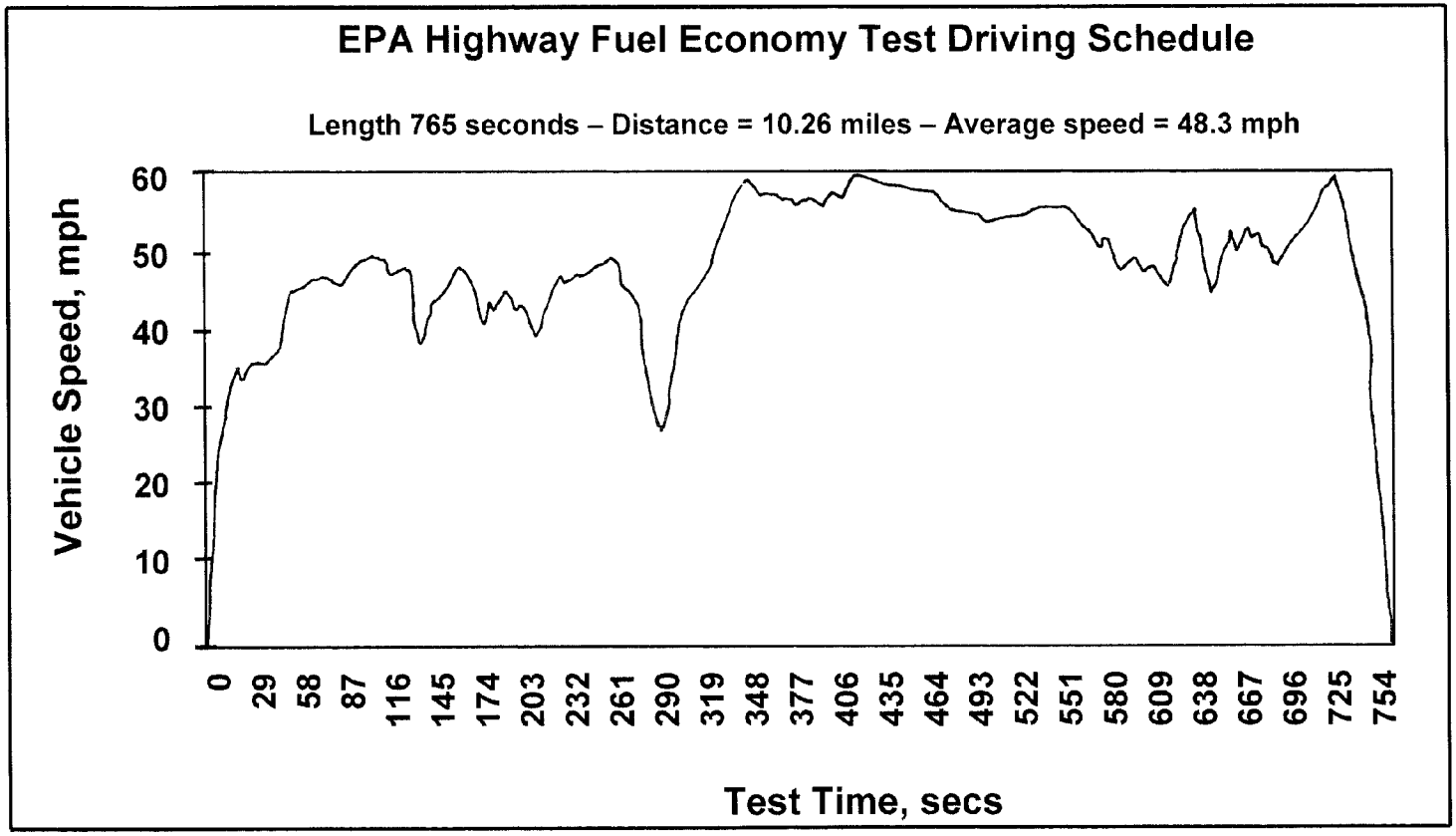
FIG. 30 is a chart illustrating a Fuel Consumption test for an EPA Highway 35 miles per hour ("MPH") driving schedule.

The EPA tests for fuel economy requires a vehicle to run through a series of pre-determined driving routines referred to as schedules or cycles that specify the vehicle speed for each point in time during the tests. FIG. 30 is a chart illustrating a Fuel Consumption test for an EPA Highway 35 MPH driving schedule. The test represents a combination of rural and interstate highway traffic with a warmed-up engine which may be representative of longer trips in free-flowing traffic. The test lasted 765 seconds, and each vehicle was driven 10.26 miles for an average speed of 48.3 MPH.

Figure 31:
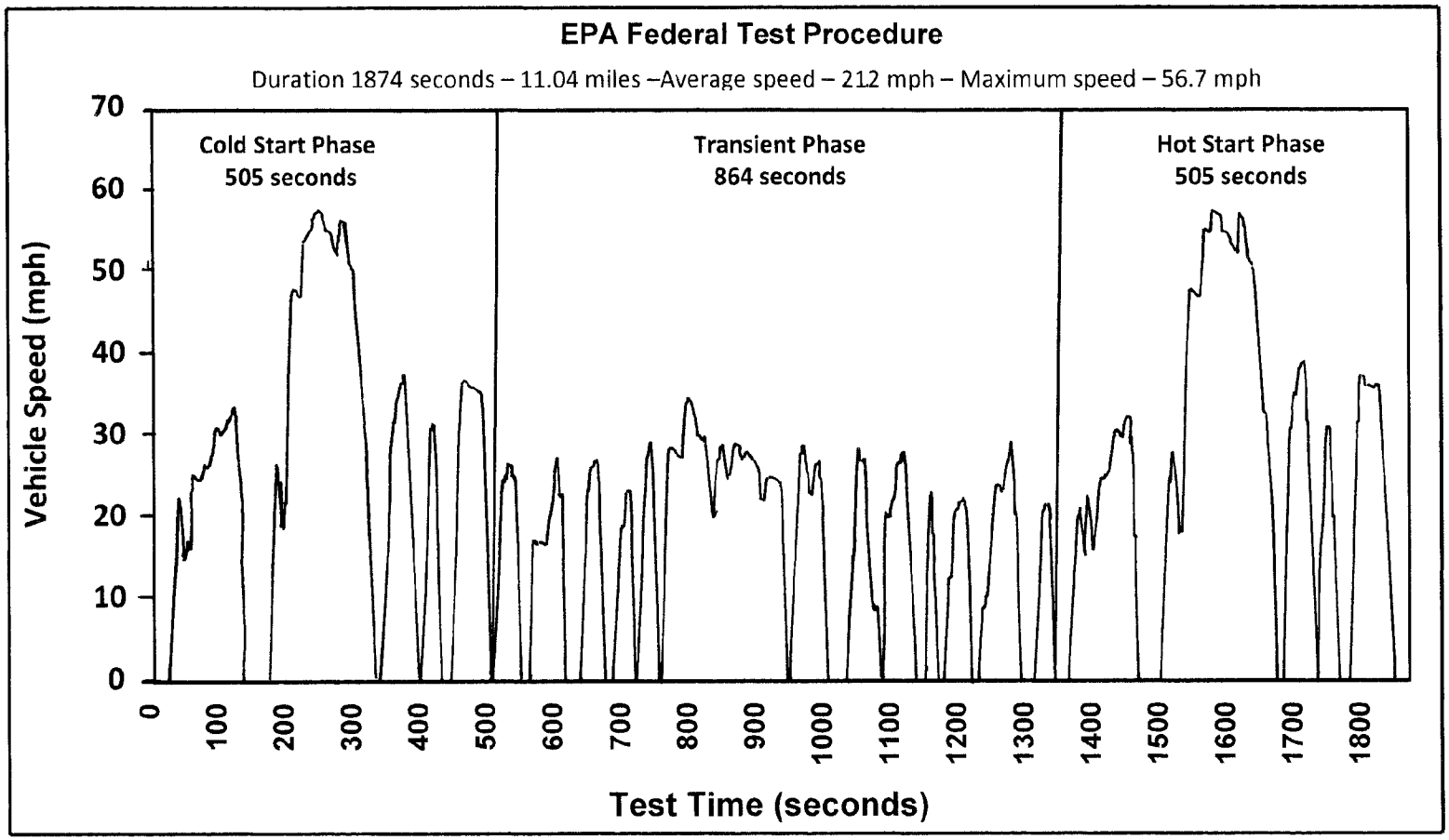
FIG. 31 is a chart illustrating a Fuel Consumption test for an EPA Highway 25 MPH driving schedule.

FIG. 31 is a chart illustrating a Fuel Consumption test for an EPA Highway 25 MPH driving schedule. The test was designed to represent urban driving where the vehicle is started with the engine cold and driven in stop-and-go traffic. The test lasts 1874 seconds, and the vehicle is driven 11.04 miles with an average speed of 21.2 MPH and a top speed of 56.7 MPH.

A driving test was performed with the 2014 TOYOTA CAMRY® to determine the fuel efficiency as a result of using embodiments of the Intelligent spark plugs described herein. The fuel consumption was determined by starting with the fuel consumption figures for a particular vehicle, a 2014 TOYOTA CAMRY®, by driving this vehicle over a test route while it was equipped with conventional spark plugs and again when the vehicle was equipped with the Intelligent spark plugs. The car equipped with conventional spark plugs exhibited a fuel economy of 27.5 MPG. In contrast, the car equipped with the Intelligent spark plugs exhibited a significantly better fuel consumption of 34.7 MPG.

Specifically, the car traveled 2,269 miles through California, Nevada, and Arizona with highway speeds ranging from 75 to 85 MPH. When the conventional spark plugs were tested, the average reading was 27.5 MPG, which is consistent with the EPA rating. When the Intelligent spark plug was employed, the average gas fuel efficient was 34.7 MPG, for a 26% increase in fuel economy.

A Dynamometer test measuring power was also performed on the same 2014 TOYOTA CAMRY®, with the best result out of 3 runs were evaluated. The dyno measurements show horsepower ("hp") produced by the same vehicle, over a range of speeds (MPH), with conventional plugs and with the Intelligent spark plugs, the overall graphs and maximum power readings showing that the vehicle exhibits similar maximum horsepower readings with the Intelligent spark plugs (that provided increase fuel consumption in terms of MPG) as compared with the conventional spark plugs.

Figure 32:
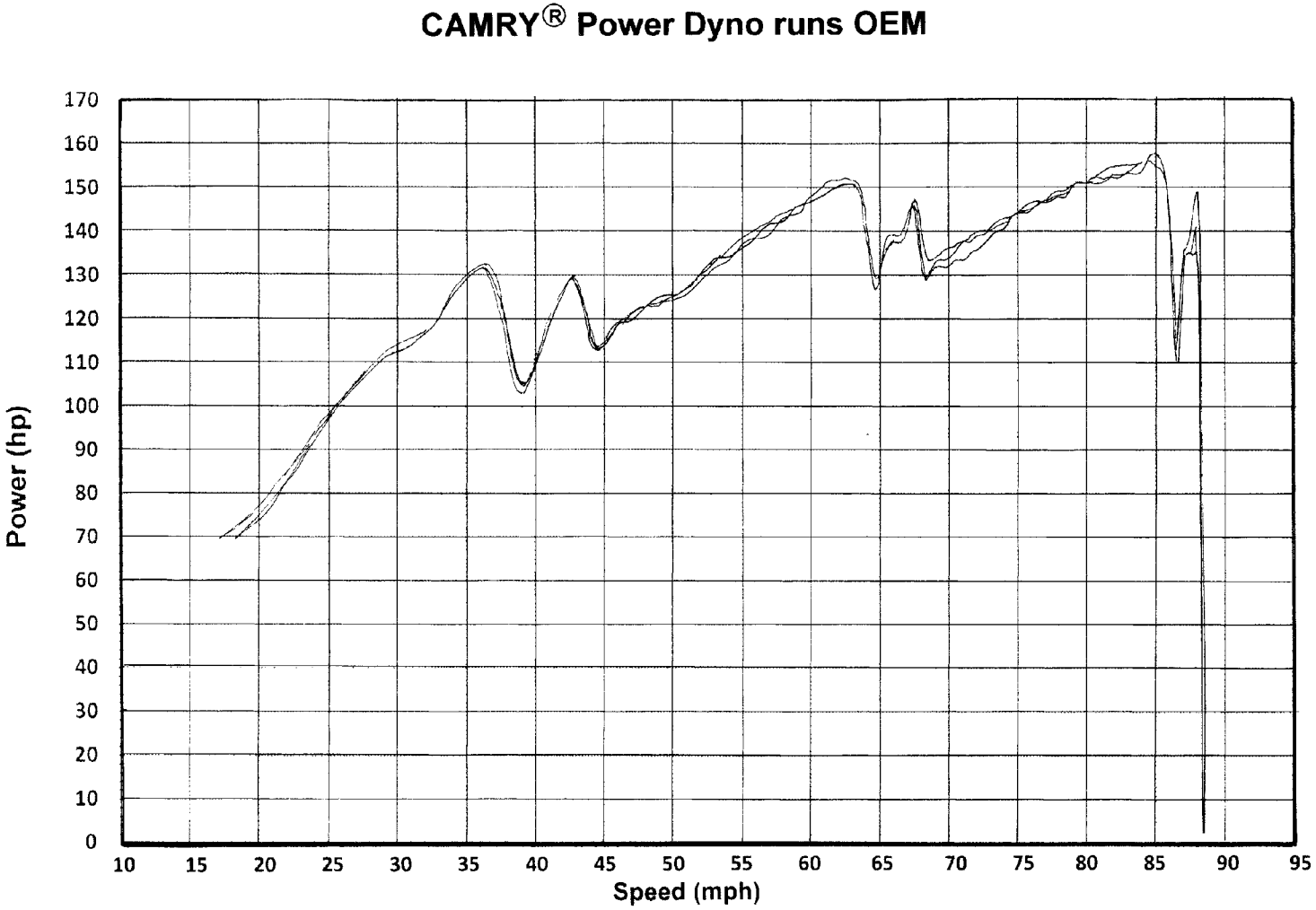
FIG. 32 is a Dynamometer test performed on an automobile employing conventional spark plugs.
Figure 33:
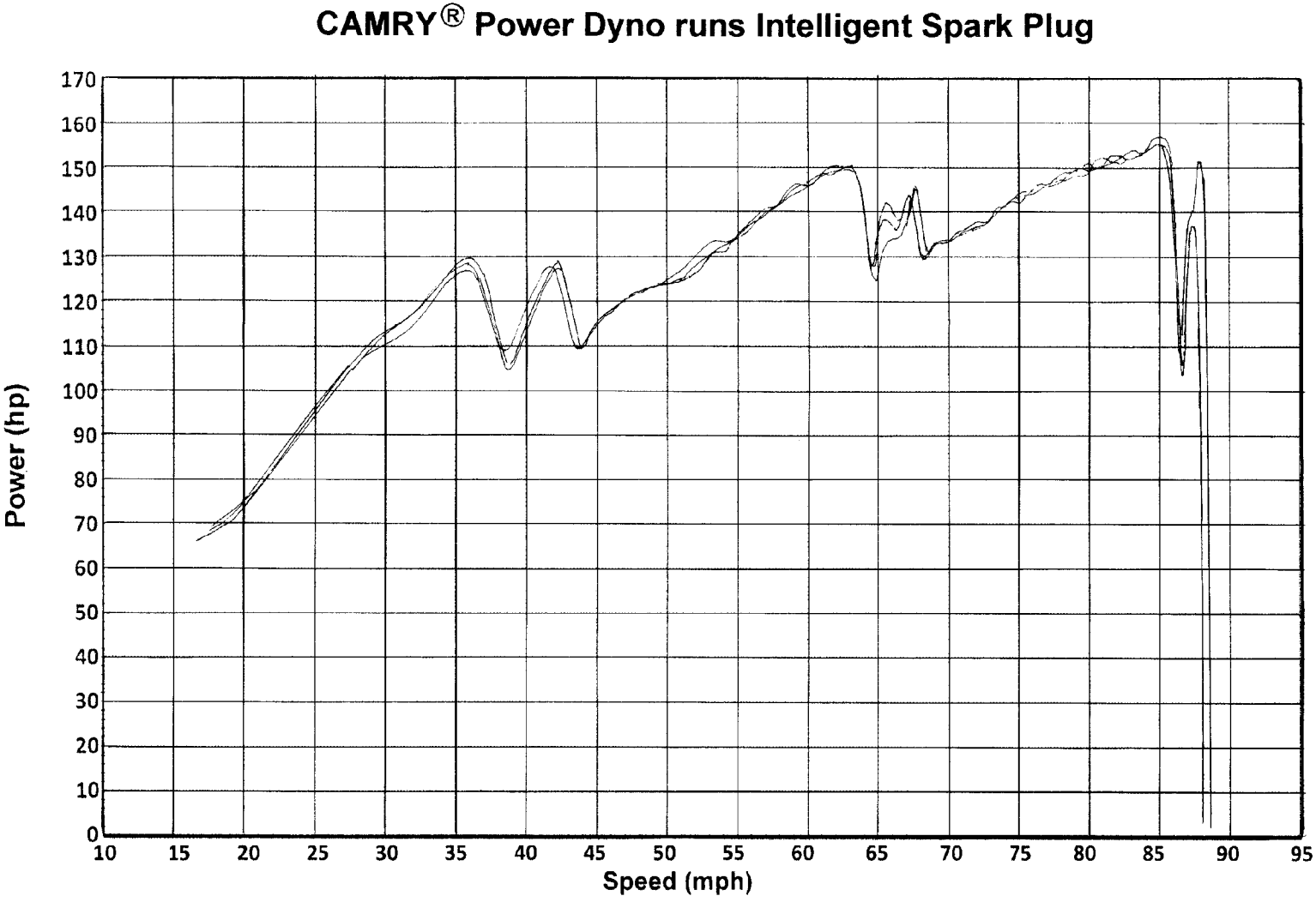
FIG. 33 is a Dynamometer test performed on an automobile employing Intelligent spark plugs.

FIG. 32 is a Dynamometer test performed on the 2014 TOYOTA CAMRY® employing conventional spark plugs. FIG. 33 is a Dynamometer test performed on the car employing Intelligent spark plugs. Both graphs are similar showing the engine producing 70 horsepower ("hp") at approximately 20 MPH, and increasing to a maximum hp at approximately 85 MPH. In summary, the 2014 TOYOTA CAMRY® generated 157.96 hp with conventional spark plugs, and 157.08 hp with the Intelligent spark plugs. Hence, the cars equipped with the Intelligent spark plug generated similar maximum horsepower as cars equipped with conventional spark plugs.

The generated torque was also measured on the 2014 TOYOTA CAMRY®. The dyno measurements that show torque produced by the same vehicle, over a range of speeds, with conventional plugs and with the Intelligent spark plugs, the overall graphs and torque readings showing that the vehicle exhibits a faster increased rate for torque with the Intelligent spark plugs (that provided increase fuel consumption in terms of MPG) as compared with the conventional spark plugs.

Figure 34:
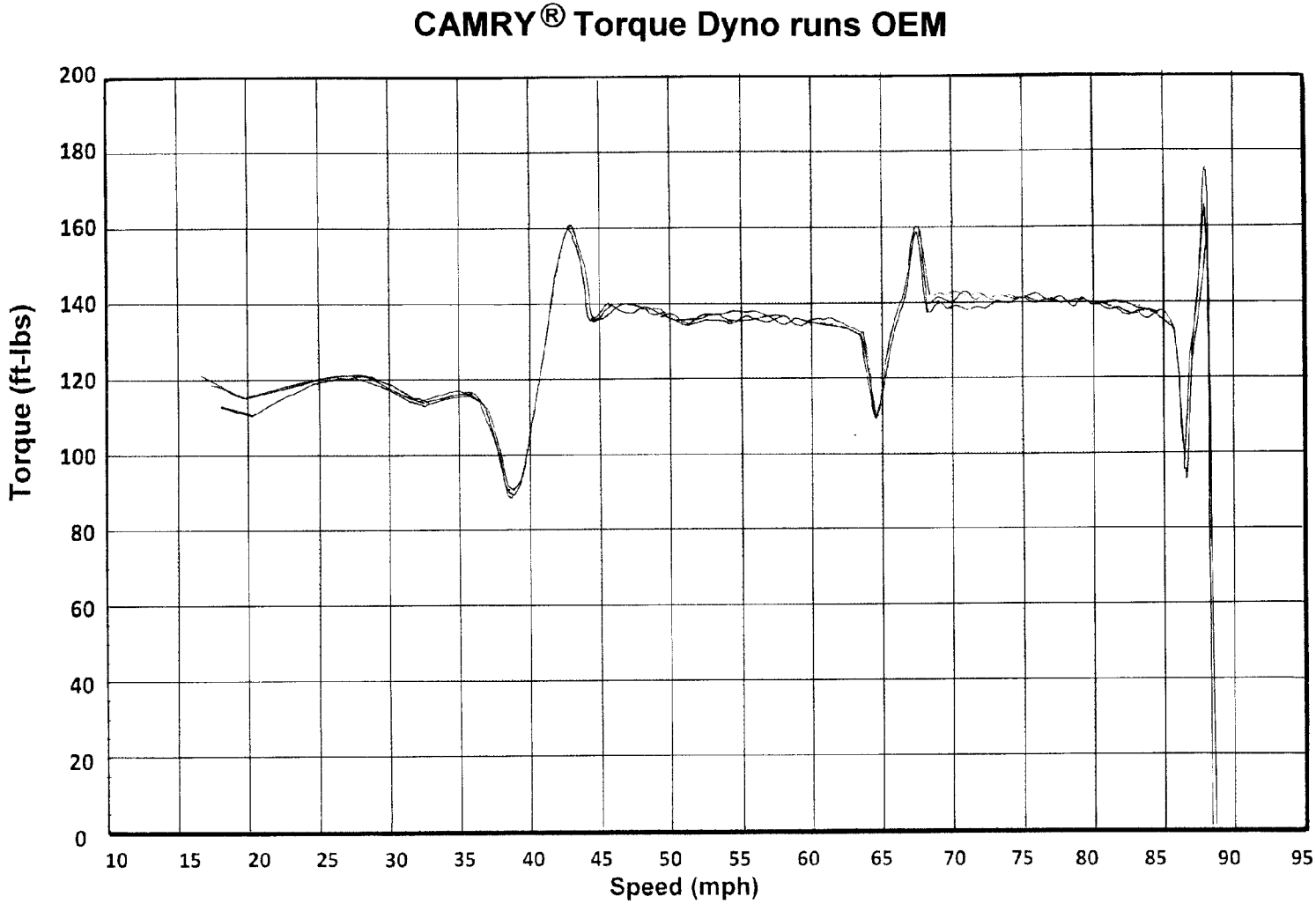
FIG. 34 is a Torque Dynamometer test performed on an automobile employing conventional spark plugs.
Figure 35:
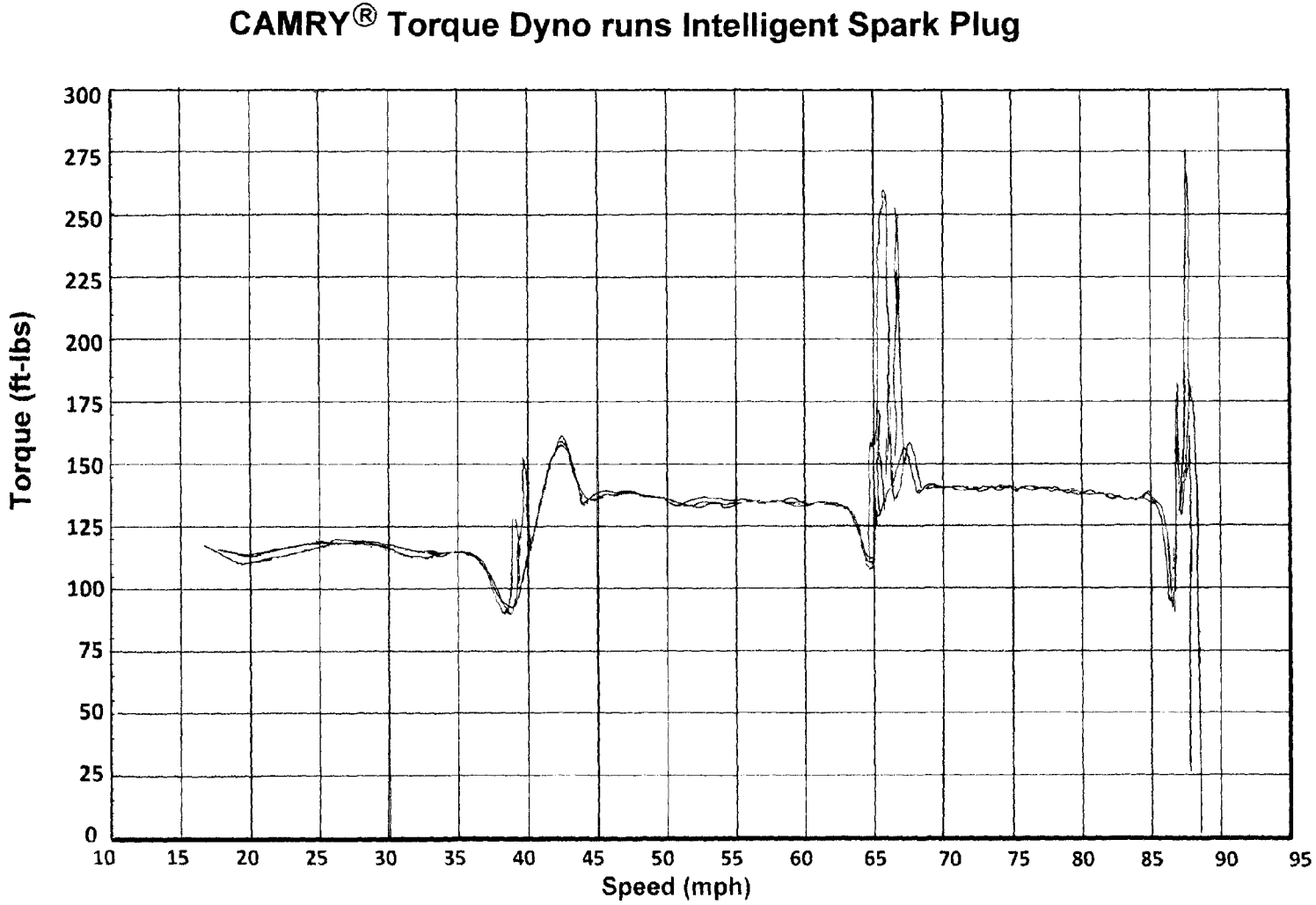
FIG. 35 is a Torque Dynamometer test performed on an automobile employing Intelligent spark plugs.
Figure 36:
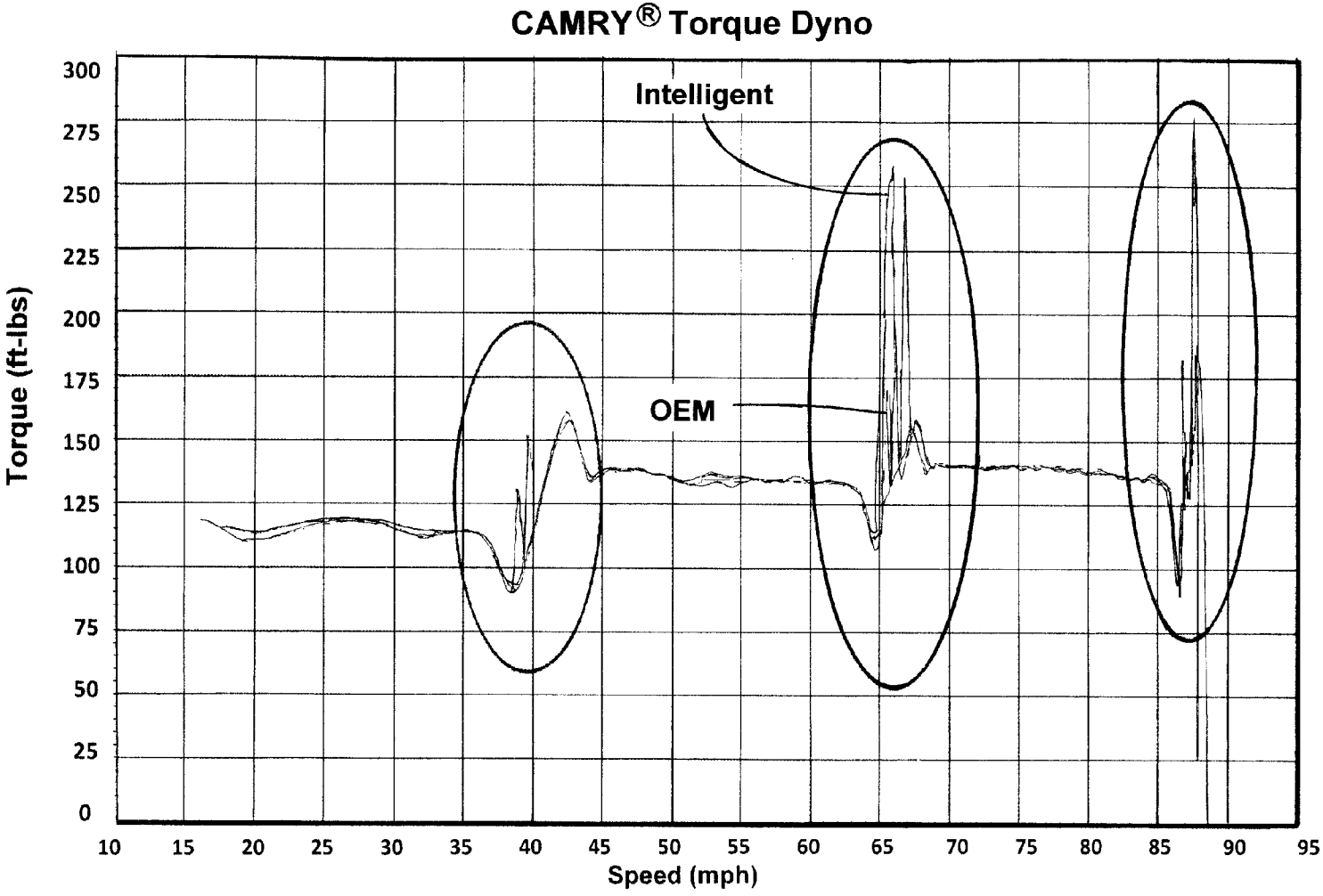
FIG. 36 is the test results a Torque Dynamometer tests performed on an automobile employing conventional and Intelligent spark plugs.

FIG. 34 is a Torque Dynamometer test performed on the TOYOTA CAMRY® employing conventional spark plugs, and FIG. 35 is a Torque Dynamometer test performed on an automobile employing Intelligent spark plugs. FIG. 36 is the test results a Torque Dynamometer tests performed on the car employing conventional and Intelligent spark plugs. The car exhibited 175.55 of foot pounds ("ft-lbs") of torque when equipped with conventional spark plugs, and 277.50 ft-lbs of torque when equipped with Intelligent spark plugs. When the car was equipped with the Intelligent spark plugs, the maximum torque increased by 58.07%, and the car exhibited a faster increase rate, and rose so quickly that the PCM cut the gas to control the rise according to the pre-programmed rate.

Hence, the first and second tests performed on difference cars suggest that cars outfitted with the Intelligent spark plug may exhibit 8 times less harmful emissions, better fuel economy, no reduction in power, greater torque, and faster, more peppy response. The overall improvements are shown in terms of less harmful emission, better fuel consumption, no power reduction, higher torque, and faster response.

Moreover, it may be easier to mandate the replacement of existing spark plugs to reduce pollution. In conclusion, the Intelligent spark plugs may deliver cleaner air, reducing the rate of global warming, fuel savings, and better a less expensive healthcare.

A third test was performed with two identical 2016 TOYOTA RAV4 ® automobiles with 2.5 L engines. Conventional Iridium spark plugs were employed in the first car, and Intelligent spark plugs were employed in the second car. The cars were both driven 193.9 miles after two hours and 33 minutes at an average speed of 76 MPH.

The car equipped with the OEM Iridium spark plugs recorded 27.4 MPG. The car equipped with Intelligent spark plugs recorded 30.2 MPG. Based on the trip computer, the car equipped with the Intelligent spark plug exhibited a 10.2% fuel consumption improvement. The fuel economy based on the mileage driven and the amount of gasoline required to refill the tanks showed a 9.2% increase in fuel economy for the automobile equipped with the Intelligent spark plug.

The TOYOTA RAV4 ® car equipped with the Intelligent spark plugs also underwent a smog check. The results of the smog check are present in Table III below.

TABLE III

Emission Report for the 2016 TOYOTA RAV4 ® with Intelligent spark plugs

| Test | RPM | % CO2 | % O2 | HC (PPM) | CO (%) | NO (PPM) |
|---|---|---|---|---|---|---|
| M1: 15 MPH | 1388 | 14.8 | 0.2 | 0 | 0.00 | 0 |
| M2: 25 MPH | 1637 | 14.8 | 0.0 | 0 | 0.00 | 0 |

The smog test revealed that the TOYOTA RAV4 ® car equipped with Intelligent spark plugs exhibited zero emission for Hydrocarbons. Carbon Monoxide and Nitrogen Oxides.

In summary, preliminary tests indicate that automobiles equipped with embodiments of the Intelligent spark may exhibit greater fuel efficiency, and reduced or eliminated emissions of Hydrocarbons, Carbon Monoxide, and Nitrogen Oxides.

There are many possible alternatives or improvements. For example, the center electrode 50 could have a diamond pattern, or otherwise be knurled, to provide enhanced spark jump opportunities. Along the same lines, the spiraling electrodes 30 could also be provide with a similar diamond pattern.

It may also be possible to use a bi-metal arrangement so that the spiraling ground electrodes 50, when exposed to the heat of combustion, expand farther apart than initially permitted by the threaded hole that receives the base of the spark plug. This would allow for an increased gap between the center electrode and the spiraling electrodes which may further increase efficiency.

The Intelligent spark plug was also tested on power tools (e.g., leaf blower, gas electrical power generator) equipped with two-stroke and four-stroke gas engines. The emissions of these engines did reduce substantially but it was also observed, especially on two-stroke engines, that the spark gaps of the 6 electrodes need to be reduced for a consistent cold start. After engine was warm, replacing the spark plug with one with the 6 electrodes arranged to a bigger spark gap improved even better the engine functionality and reduced even more the emissions. This observation led to the creation of a new version of the Intelligent spark plug specially designed for engines equipped with sources of high voltage unable to cover big spark gaps at cold start.

The Low Voltage Intelligent spark plug has one of the electrodes built from bi-metal material or PTC (Positive Temperature Coefficient) material. This new electrode will create a smaller spark gap when the engine is at cold start. After engine start functioning the heat created inside the combustion chamber will make the new electrode move away from the center electrode beyond the rest of the bigger gap electrodes (bi-metal version) or increase the impedance path of that electrode (PTC version), and let the rest of the bigger gap electrodes do their job of hunting the fuel rich areas and ignite in that place for a fast and efficient combustion.

Figure 37:
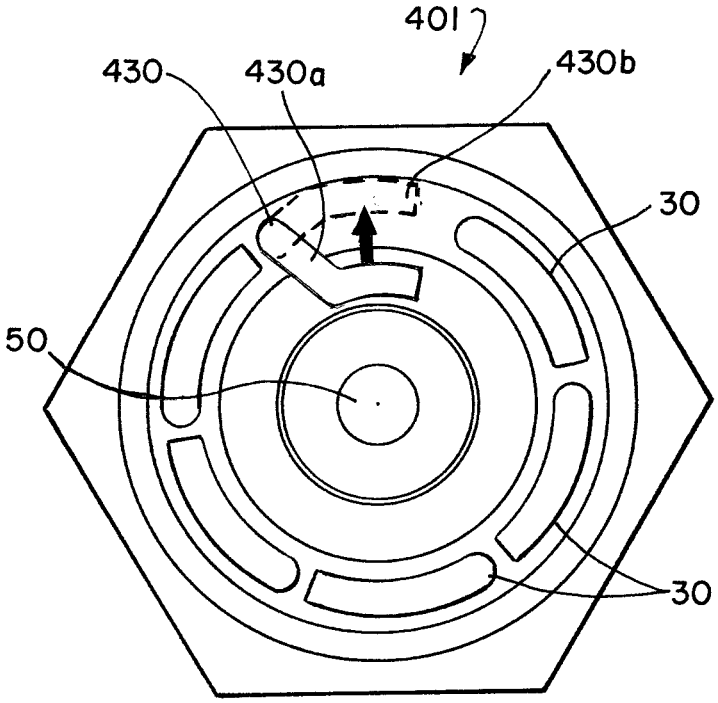
FIG. 37 is a bottom view of a Low Voltage Intelligent spark plug employing a bi-metal electrode.

FIG. 37 is a bottom view of a Low Voltage Intelligent spark plug 401 employing a bi-metal electrode 430. In one or more embodiments, one of the plurality of ground electrodes comprises a bi-metal structure configured to move radially away from the center electrode 50 with increased temperature. When the ambient temperature is low, electrode 430 is positioned as depicted by 430*a*. As illustrated schematically, the increased temperature of the engine changes the position of the bi-metal electrode 430 by moving the electrode from shape 430*a* to shape 430*b* beyond the other electrodes 30.

Figure 38:
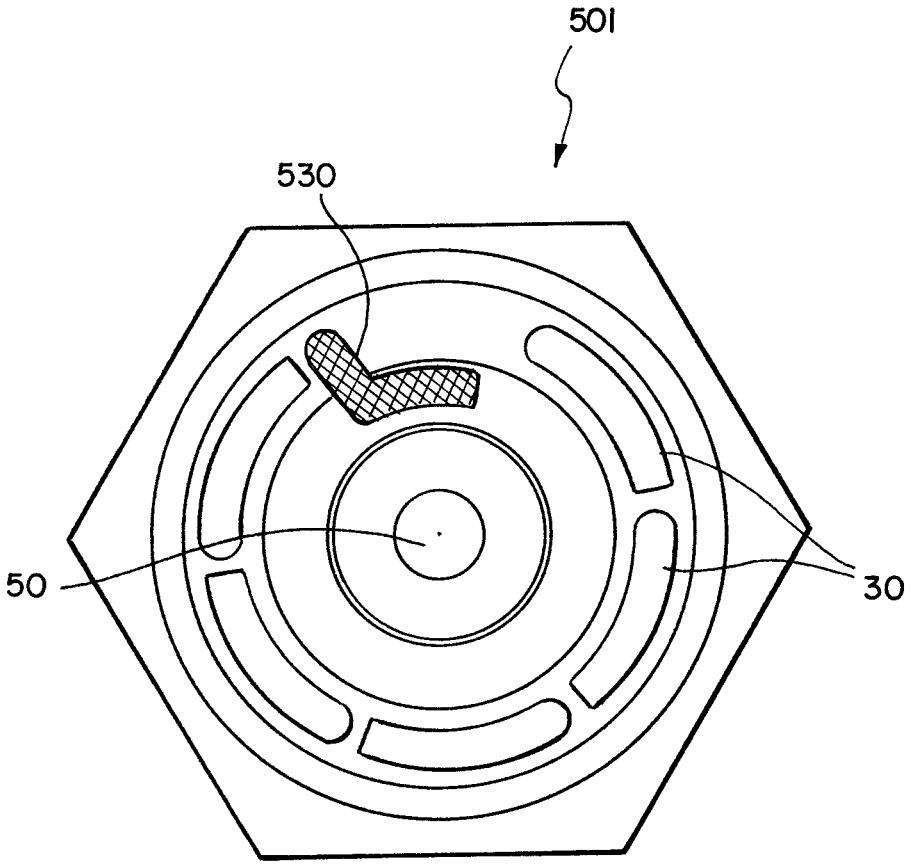
FIG. 38 is a bottom view of a Low Voltage Intelligent spark plug employing positive temperature coefficient electrode.

FIG. 38 is a bottom view of a Low Voltage Intelligent spark plug 501 employing positive temperature coefficient electrode 530. In one or more embodiments, one of the plurality of ground electrodes 530 comprises a conductor having a Positive Temperature Coefficient which increases the electrical resistance with increasing temperature. The electrode 530 is fabricated from material that exhibits a positive temperature coefficient. As the temperature of the plug 501 increases, the impedance of the electrode 530 will increase such that the electrodes 30 will participate with the spark firings.

Another alternative embodiment is a Variable Gap Intelligent Spark Plug with one fixed ground electrode that is closer to the center electrode (to help the cold start on low voltages) and a number of 4, 5, 6 or more electrodes, all at a greater distance (sparking gap) from the center electrode. One or more embodiments further comprise an additional fixed ground electrode positioned closer to the center electrode than the plurality of ground electrodes.

Figure 39:
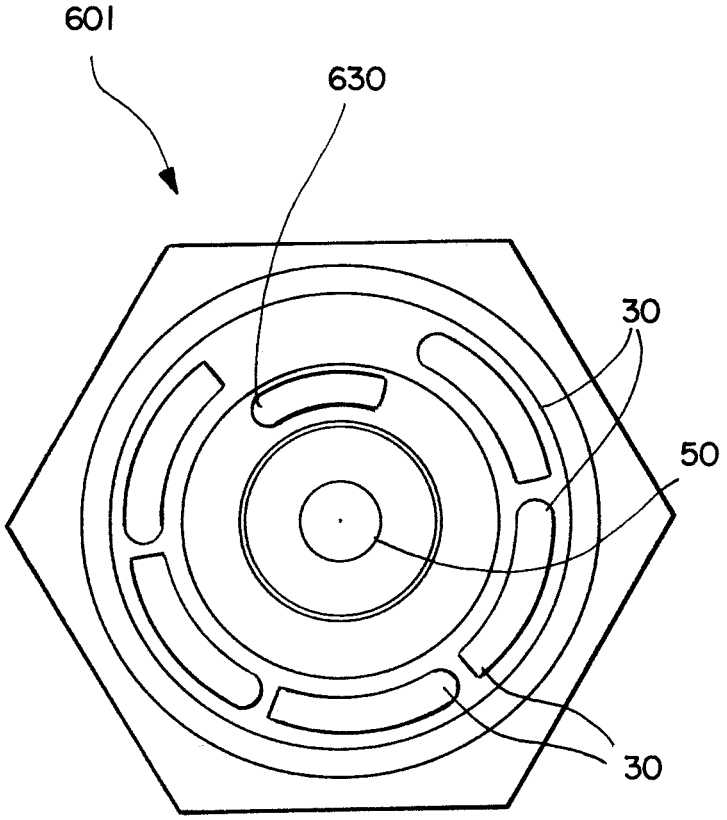
FIG. 39 is a bottom view of a Variable Gap Intelligent spark plug.

FIG. 39 is a bottom view of a Variable Gap Intelligent spark plug 601 showing one fixed ground electrode 630 which closer to the center electrode 50. During experiments, it was observed that even after the engine cold start moment, when the bi-metal ground electrode is closer to the center electrodes, the other electrodes (5 in this case) are still helping on hunting the richer paths and the engine emissions are lower.

It is believed that once the engine starts running, the compression and the heat applied to the fuel-air mixture make the sparking gap difference between the ground electrodes less relevant and the other 5 electrodes with bigger spark gap will still work on hunting fuel richer areas due to low impedance path of these areas. During testing at room temperature, as expected, the spark discharge occurred all the time between the center electrode and the closer ground electrode when no propane gas was present. However, once the propane was introduced into the area with the other 5 ground electrodes with bigger spark gap, the spark discharge will move from the initial ground electrode with smaller sparking gap to whatever electrode with bigger sparking gap is closer to the propane gas.

The demand for spark plugs is projected to grow significantly for the foreseeable future. As of 2010, there are over one billion motor vehicles in use in the world, excluding off-road vehicles and snowmobiles, scooters and motorbikes, motorboats, and small tools and construction equipment, which also require spark plugs to function. U.S. researchers estimate that size of the world's fleets will double, reaching two billion motor vehicles by 2020. Big growth is expected from developing economies of the BRICS (i.e., Brazil, Russia, India, China, and South Africa). China, the fastest growing large economy is also the fastest growing market for automobiles, now with over 100 million vehicles on the road. The USA currently has the most number of vehicles, with over 250 million vehicles, and China is expected to overtake USA as the largest automobile market on the planet.

In 2015, the market reached some 1.5 billion vehicles. Two-thirds or some one billion vehicles are powered by gas engines, and one-third are powered by diesel, hydrogen, or electricity. Each gas engine uses four to twelve spark plugs. Considering an average of 5 spark plugs for today's one billion gas engines, there are about five billion spark plugs in use currently.

By 2020, two billion motor vehicles are expected to be on the road, increasing at a rate of 100,000,000 vehicles per year. Gas engines accounts for two-thirds of the total of some 65,000,000 per year and need an average of five spark plugs. This means that there is a need of more than 300,000,000 spark plugs just for new gas engines. There is also an additional spark plug need for replacement and service, scooters and motorbikes, off-road vehicles and snowmobiles, motorboats, and small tools and construction equipment.

The cost of manufacturing a spark plug is approximately US$0.50 in volume. The wholesale prices range from US$1-US$4 per unit. One company's starting prices are US$0.96 per unit. The retail price ranges from US$2.50 up to US$30 for premium plugs, giving a margin of in excess of US$0.50 per unit. Hence, 300,000,000 spark plugs can generate a total margin of at least US$150,000,000 per year. Replacement spark plugs can generate a lot more revenue, especially if mandated for reducing pollution. There are currently five major spark plug manufacturers: BOSCH®, NGK®, CHAMPION®, DENSO®, and AUTOLITE®.

Although the invention has been discussed with reference to specific embodiments, it is apparent and should be understood that the concept can be otherwise embodied to achieve the advantages discussed. The preferred embodiments above have been described primarily as spark plugs having multiple ground electrodes forming a large spark target volume. In this regard, the foregoing description of the spark plugs is presented for purposes of illustration and description.

Furthermore, the description is not intended to limit the invention to the form disclosed herein. Accordingly, variants and modifications consistent with the following teachings, skill, and knowledge of the relevant art, are within the scope of the present invention.

The concepts discussed herein may be applied to other spark creation devices or for applications including internal combustion engines for automobiles, trucks, power tools, and other vehicles as well for other types of engines. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A spark plug comprising:

an insulating body having an open bore;

a tubular conductive shell surrounding at least a portion of the insulating body;

a cylindrical center electrode positioned within the bore of the insulating body, the center electrode having a central longitudinal axis, the center electrode protruding from the insulating body forming a terminal end portion adapted to act as a spark generating portion; and, a plurality of ground electrodes radially surrounding the center electrode forming a 360 degree spark target volume, each ground electrode having a base end coupled to the conductive shell and an elongated upper portion that extends from the base end to a distal end that is longitudinally spaced from the base end and that also curves around the central longitudinal axis to form a generally curved path and provide an elongated inner surface having a generally constant radial spark gap distance from the spark generating portion of the center electrode.

2. The spark plug of claim 1, wherein the generally curved path comprises a helix formed about the longitudinal axis of the center electrode.

3. The spark plug of claim 1, wherein the radial spark gap is in the range of approximately 1.7 millimeters to approximately 4.75 millimeters.

4. The spark plug of claim 1, wherein the spark generating portion of the center electrode and the elongated upper portions of the ground electrodes form a three-dimensional spark target volume.

5. The spark plug of claim 4, wherein the spark target volume is approximately 100 cubic millimeters.

6. The spark plug of claim 1, wherein the spark target volume comprises a generally open volume adopted for allowing free propagation of fuel burn.

7. The spark plug of claim 1, wherein one of the plurality of ground electrodes comprises a bi-metal structure configured to move radially away from the center electrode with increased temperature.

8. The spark plug of claim 1, wherein one of the plurality of ground electrodes comprises a conductor having a Positive Temperature Coefficient which increases the electrical resistance of said conductor having the Positive Temperature Coefficient with increasing temperature.

9. The spark plug of claim 1, further comprising an additional fixed ground electrode positioned closer to the center electrode than the plurality of ground electrodes.

10. The spark plug of claim 1, wherein the plurality of ground electrodes comprises six ground electrodes.

11. The spark plug of claim 1, wherein the elongated upper portions of each ground electrodes partially overlaps the base end of an adjacent ground electrodes when viewed along the central longitudinal axis.

12. A spark plug comprising:

an insulating body having an open bore;

a tubular conductive shell surrounding at least a portion of the insulating body;

a cylindrical center electrode positioned within the bore of the insulating body, the center electrode having a central longitudinal axis, the center electrode protruding from the insulating body forming a terminal end portion adapted to act as a spark generating portion; and, a plurality of cylindrical ground electrodes radially surrounding the center electrode forming a 360 degree, three-dimensional spark target volume, each ground electrode having a base end coupled to the conductive shell and an elongated upper portion that extends from the base end to a distal end that is longitudinally spaced from the base and that also curves around the central longitudinal axis to form a generally curved path and provide an elongated inner surface having a generally constant radial spark gap distance from the spark generating portion of the center electrode, the ground electrodes surrounding the center electrode in a circumferentially overlapping manner wherein the elongated upper portion of each ground electrode partially overlaps the lower base end of an adjacent ground electrode when viewed along the central longitudinal axis;

wherein the spark generating portion of the center electrode and the elongated upper portions of the ground electrodes form the three-dimensional spark target volume, and wherein the spark target volume is up to approximately 100 cubic millimeters.

13. The spark plug of claim 12, wherein one of the plurality of ground electrodes comprises a bi-metal structure configured to move radially away from the center electrode with increased temperature.

14. The spark plug of claim 12, wherein one of the plurality of ground electrodes comprises a conductor having a Positive Temperature Coefficient which increases the electrical resistance with increasing temperature.

15. The spark plug of claim 12, further comprising an additional fixed ground electrode positioned closer to the center electrode than the plurality of ground electrodes.

16. The spark plug of claim 12, wherein the plurality of ground electrodes comprises six ground electrodes.

17. A spark plug comprising:

a cylindrical center electrode having a central longitudinal axis, the center electrode forming a terminal end portion adapted to act as a spark generating portion; and, a plurality of ground electrodes radially surrounding the center electrode forming a 360 degree, three-dimensional spark target volume, each ground electrode having a base and an elongated upper portion that extends from the base end to a distal end that is longitudinally spaced from the base end and that also curves around the central longitudinal axis to form a generally curved path and provide an elongated inner surface having a generally constant radial spark gap distance from the center electrode.

18. The spark plug of claim 17, wherein the spark target volume is up approximately 100 cubic millimeters.

19. The spark plug of claim 17, wherein the spark target volume comprises a generally open volume adopted for allowing free propagation of fuel burn.

20. The spark plug of claim 17, wherein the elongated upper portions of each ground electrodes partially overlaps the base end of an adjacent ground electrodes when viewed along the central longitudinal axis.

* * * * *